US006475245B2

(12) United States Patent
Gersho et al.

(10) Patent No.: US 6,475,245 B2
(45) **Date of Patent: *Nov. 5, 2002**

(54) METHOD AND APPARATUS FOR HYBRID CODING OF SPEECH AT 4KBPS HAVING PHASE ALIGNMENT BETWEEN MODE-SWITCHED FRAMES

(75) Inventors: Allen Gersho, Goleta, CA (US); Eyal Shlomot, Irvine, CA (US); Vladimir Cuperman, Goleta, CA (US); Chunyan Li, Goleta, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/777,424

(22) Filed: Feb. 5, 2001

(65) Prior Publication Data

US 2001/0023396 A1 Sep. 20, 2001

Related U.S. Application Data

(63) Continuation of application No. 09/143,265, filed on Aug. 28, 1998, now Pat. No. 6,233,550.

(60) Provisional application No. 60/057,415, filed on Aug. 29, 1997.

(51) Int. Cl.[7] ..... G10L 11/06; G10L 19/02; G10L 19/04

(52) U.S. Cl. ..... 784/208; 704/214; 704/219; 704/220

(58) Field of Search ..... 704/208, 214, 704/219, 220

(56) References Cited

U.S. PATENT DOCUMENTS

| | | | |
|---|---|---|---|
| 3,624,302 | A | 11/1971 | Atal |
| 4,609,788 | A | 9/1986 | Miller et al. |
| 4,611,342 | A | 9/1986 | Miller et al. |
| 4,885,790 | A | 12/1989 | McAulay et al. |
| 5,195,166 | A | 3/1993 | Hardwick et al. |
| 5,216,747 | A | 6/1993 | Hardwick et al. |
| 5,226,108 | A | 7/1993 | Hardwick et al. |
| 5,274,740 | A | 12/1993 | Davis et al. |
| 5,285,498 | A | 2/1994 | Johnston |
| 5,481,553 | A | 1/1996 | Suzuki et al. |
| 5,504,834 | A | 4/1996 | Fette et al. |
| 5,581,656 | A | 12/1996 | Hardwick et al. |
| 5,583,962 | A | 12/1996 | Davis et al. |
| 5,592,584 | A | 1/1997 | Ferreira et al. |
| 5,704,003 | A | 12/1997 | Kleijn et al. |
| 5,774,837 | A | 6/1998 | Yeldener et al. |
| 5,787,387 | A | 7/1998 | Aguilar |
| 5,884,252 | A | 3/1999 | Ozawa |
| 5,933,802 | A | 8/1999 | Emori |

FOREIGN PATENT DOCUMENTS

| | | |
|---|---|---|
| EP | A 127 729 | 12/1984 |

OTHER PUBLICATIONS

ITU–T, Telecommunication Standardization Sector of ITU, Dual Rate Speech Coder for Multimedia Communications Transmitting at 5.3 & 6.3 KBIT/S, Geneva, Switzerland, pp. 1–35, Oct., 1995.

(List continued on next page.)

*Primary Examiner*—Tālivaldis Ivars Šmits
(74) *Attorney, Agent, or Firm*—John P. O'Banion

(57) ABSTRACT

A method and apparatus for encoding speech for communication to a decoder for reproduction of the speech where the speech signal is classified into steady state voiced (harmonic), stationary unvoiced, and "transitory" or "transition" speech, and a particular type of coding scheme is used for each class. Harmonic coding is used for steady state voiced speech, "noise-like" coding is used for stationary unvoiced speech, and a special coding mode is used for transition speech, designed to capture the location, the structure, and the strength of the local time events that characterize the transition portions of the speech. The compression schemes can be applied to the speech signal or to the LP residual signal.

10 Claims, 15 Drawing Sheets

OTHER PUBLICATIONS

Almeida, L.B. et al., Nonstationary Spectral Modeling of Voiced Speech, IEEE Transactions on Acoustics, Speech and Signal Processing, vol. 31, No. 3, pp. 664–678, Jun., 1993.
Kleijn, W., "Encoding Sppech using Prototype Waveforms," IEEE Transactions on Speech and Audio Processing, vol. 1, No. 4, pp. 386–399, Oct., 1993.
Gersho, Allen, "Advances in Speech and Audio Compression," IEEE Proceedings, vol. 82, No. 6, pp. 900–918, especially pp. 909–910, Jun. 1994.
Ozawa, Kazunori; Scirzawa, Masahiro; Miyano, Toshiki; and Nomura, Toshiyuki, "M–LCELP Speech Coding at 4 Kbps," Proceeding IEEE ICASSP 94, vol. 1, pp. 269–272, Apr. 1994.
Hedelin, P., High Quality Glottal LPC–Vocoding, Proceeding of the IEEE International Conference on Acoustics, Speech, and Signal Processing, pp. 465–468, 1986.
McAulay, R.J. et al., Sinusoidal Coding, Speech Coding and Synthesis (W.B. Kleijn and K.K. Paliqal, eds.) Amsterdam: Elsevier Science Publishers, Chapter 4, pp. 121–173, 1995.
Griffin, D.W. et al., Multi–Band Excitation Vocoder, IEEE Transactions on acoustics, Speech, and Signal Processing, vol. 36, No. 8, pp. 1223–1235, Aug., 1988.
Digital Voiced System, Inc., Inmarsat–M SDM corrigenda No. 5, Attachment 1, Inmarsat M. Voice Codec Version 2, pp. 1–141, Feb., 1991.
Kleijn, W.B., Encoding Speech Using Prototype Waveform, IEEE Transactions on Speech and Audio Processing, vol. 1, No. 4, pp. 386–399, Oct., 1993.
Shoham, Y., High–Quality Speech Coding at 2.4 to 4.0 KBPS Based on Time Frequency Interpolation, Proceedings of the IEEE International Conference on Acoustics, Speech, and Signal Processing, vol. 2, pp. 167–170, 1993.
McCree, A. et al., A Mixed Excitation LPC Vocoder Model for Low Bit Rate Speech Coding, IEEE Transactions on Speech and Audio Processing, vol. 3, No. 4, pp. 242–250, Jul. 1995.
El–Jaroudi, A. et al., Discrete All–Pole Modeling, IEEE Transactions on Signal Processing, vol. 39, No. 2, pp. 423–441, Feb., 1991.
Nishiguchi, M. et al., Vector Quantized MBE with Simplified V/UV Division at 3.0 KBPS, Proceedings at the IEEE International Conference on Acoustics, Speech, and Signal Processing, vol. 2, pp. 15–154, 1993.
Das, A. et al., Variable–Dimension Vector Quantization of Speech Spectra for Low–Rate Vocoders, Proceedings of Data Computing Conference, pp. 421–429, 1994.
Lupini, P. et al. Non–Square Transform Vector Quantization for Low–Rate Speech Coding, IEEE Speech Coding Workshop (Annapolis, MD), pp. 87–89, 1995.
Trancoso, I. et al., A Study on the Relationship Between Stochastic and Harmonic Coding, Proceedings of teh IEEE International Conference on Acoustics, Speech, and Signal Processing, pp. 1709–1712, 1986.
Nishiguchi, M. et al., Harmonic Vector Excitation Coding of Speech at 2.0 KBPS, Proceedings of the IEEE Speech Coding Workshop (Pocono Manor, PA), pp. 39–40, 1997.
Sun, X. et al., Phase Modeling of Speech Excitation for Low Bit–Reate Sinusoidal Transform Coding, Proceedings of the IEEE International Conference on Acoustics, Speech and Signal Processing, vol. 3, pp. 1691–1694, 1997.
Nishiguchi, M. et al., Harmonic and Noise Coding of LPC Residuals with Classified Vector Quantization, Proceedings of the IEEE International Conference on Acoustics, Speech, and Signal Processing, pp. 484–487, 1995.
Kleijn, W. et al., A Low–Complexity Waveform Interpolation Coder, Proceedings of the IEEE International Conference on Acoustics, speech, and Signal Processing, pp. 212–215, 1996.
Yeldener, S. et al., High Quality Multiband LPC Coding of Speech at 2.4 KBPS, Electronics Letters, vol. 27, No. 14, pp. 1287–1289, Jul., 1991.
Cuperman, V. et al., Special Excitation Coding of Speech at 2.4 KBPS, Proceeding of the IEEE International Conference on Acoustics, Speech, and Signal Processing, pp. 496–499, 1995.
LeBlanc, W. et al., Efficient Search and Design Procedures for Robust Multi–Stage VQ of LPC Parameters for 4 KBPS Speech Coding, IEEE Transactions on Speech and Audio Processing, vol. 1, No. 4, pp. 373–385, Oct., 1993.
Shlomot, E., Delayed Decision Switched Prediction Multi–Stage LSF Quantization, Proceedings of the IEEE Speech Coding Workshop (Annapolis, MD), pp. 45–46, 1995.
Paliwal, K. et al., Efficient Vector Quantization of LPC Parameters at 24 Bits/Frame, IEEE Transactions on Speech and Audio Processing, vol. 1, No. 1, pp. 3–14, Jan., 1993.
Wang, S. et al., Phonetic Segmentation for Low Rate Speech Coding, Advances in Speech Coding (B.A. Atal, V. Cuperman, and A. Gersho, eds.), Boston/Dordrect/London: Kluwer Academic Publications, pp. 225–234, 1991.
Das, A. et al., Multimode and Variable–Rate Coding of Speech, Speech Coding and Synthesis, (W.B. Kleijn and K.K. Paliwal, eds.), Amsterdam: Elsevier Science Publishers, Chapter 7, pp. 257–287, 1995.
Benyassine, A. et al., a Robust Low Complexity Voice Activity Detection Algorithm for Speech Communication Systems, Proceedings of IEEE Speech Coding Workshop, (Pocono Manor, PA), pp. 97–98, 1997.
Wang, T. et al., A High Quality MBE–LPC–FE Speech Coder at 2.4 KBPS and 1.2 KBPS, Proceedings of IEEE International Conference on Acoustics, Speech, and Signal Processing, vol. 1, pp. 208–211, 1996.
Das, A. et al., Variable Dimension Vector Quantization, IEEE Signal Processing Letters, vol. 3, pp. 200–202, Jul., 1996.
Thyssen, J. et al., Using a Preception–Based Frequency Scale in Waveform Interpolation, Proceedings of the IEEE International Conference on Acoustics, Speech, and signal Processing, pp. 1595–1598, 1997.
Shlomot, E. et al., Hybrid Coding of Speech at 4 KBPS, Proceedings of the IEEE Speech Coding Workshop, (Pocono Manor, PA), pp. 37–38, 1997.
Burnett, I.S. et al., Multi–Prototype Waveform Coding Using Frame–By–Frame Analysis–By–Synthesis, IEEE International Conference on Acoustics, Speech, and Signal Processing, pp. 1567–1570, 1997.
Schroeder, M. et al., Code–Excited Linear Prediction (CELP): High–Quality Speech at Very Low Bit Rates, Proceedings of the IEEE International Conference on Acoustics, Speech, and Signal Processing, pp. 937–940, 1985.
Kleijn, W.B. et al., Generalized Analysis–By–Synthesis Coding and its Application of Pitch Prediction, Proceedings of the IEEE International Conference on Acoustics, Speech, and Signal Processing, vol. 1, pp. 337–340, 1992.
TIA Draft Standard, TIA/EIA/IS–27, Enhanced Rate Codec (EVRC), pp. i–B–18, 1996.

METHOD AND APPARATUS FOR HYBRID CODING OF SPEECH AT 4KBPS HAVING PHASE ALIGNMENT BETWEEN MODE-SWITCHED FRAMES

CROSS-REFERENCE TO RELATED APPLICATIONS

This application is a continuation of application Ser. No. 09/143,265 filed on Aug. 28, 1998, now U.S. Pat. No. 6,233,550 issued May 15, 2001, which claims priority from provisional application Ser. No. 60/057,415 filed on Aug. 29, 1997.

STATEMENT REGARDING FEDERALLY SPONSORED RESEARCH OR DEVELOPMENT

REFERENCE TO A MICROFICHE APPENDIX

Not Applicable

BACKGROUND REFERENCE

The following publications which are sometimes referred to herein using numbers inside square brackets (e.g., [1]) are provided for those desiring a more detailed look at the technical background discussed in the section:

[1] E. Shlomot, V. Cuperman, and A. Gersho, "Combined Harmonic and Waveform Coding of Speech at Low Bit Rates," ICASSP '98, April 1998.

[2] ITU-T, Telec. Stand. Sector, Geneva, Switzerland, *Dual Rate Speech Coder for Multimedia Communications Transmitting at* 5.3 & 6.3 *Kbit/s,* October 1995.

[3] T. E. Tremain, "The government standard linear prediction coding algorithm: LPC-10," *Speech Technology,* pp. 40–49, April 1982.

[4] L. B. Almeida and J. M. Tribolet, "Non-stationary spectral modeling of voiced speech," *IEEE Trans. Acoust., Speech and Sig. Process.,* vol. 31, pp. 664–678, June 1993.

[5] P. Hedelin, "High quality glottal LPC-vocoding," in Proc. *IEEE Intr. Conf. Acoust., Speech, Sig. Process.,* pp. 465–468, 1986.

[6] R. J. McAulay and T. F. Quatieri, "Sinusoidal coding," in *Speech Coding and Synthesis* (W. B. Kleijn and K. K. Paliwal eds,), Amsterdam: Elsevier Science Publishers, 1995.

[7] D. W. Griffin and J. S. Lim, "Multi-band excitation vocoder," *IEEE Trans. Acoust., Speech and Sig. Process.,* vol. 1, pp. 1223–1235, August 1998.

[8] Digital Voiced System, Inc., *Inmarsat-M Voice Codec Specification, Version* 2, 1991.

[9] W. B. Kleijn, "encoding speech using prototype waveform," *IEEE Trans. Acoust., Speech and Sig. Process.,* vol. 1, pp. 386–399, October 1993.

[10] Y. Shoham, "High-quality speech coding at 2.4 to 4.0 kbps based on time-frequency interpolation," in Proc. *IEEE Intr. Conf. Acoust., Speech, Sig. Process.,* pp. 167–170, 1993. Vol. II.

[11] A. McCree and T. P. Barnwell III, "A mixed excitation LPC vocoder model for low bit rate speech coding," *IEEE Trans. Speech, Audio Process.,* vol. 3, pp. 242–250, July 1995.

[12] A. El-Jaroudi and Makhoul, "Discrete all-pole modeling," IEEE *Trans. Sig. Process.,* vol. 39, pp 441–423, February 1991.

[13] M. Nishiguchi, J. Matsumoto, R. Wakatsuki, and S. Ono, "Vector quantized MBE with simplified v/uv division at 3.0 kbps," in *Proc. IEEE Inter. Conf. Acoust., Speech, Sig. Process.,* pp. II151–II154, 1993.

[14] A. Das, A. V. Rao, and A. Gersho, "Variable-dimension vector quantization of speech spectra for low-rate vocoders," in *Proc. Data Comp. Conf.,* pp. 421–429, 1994.

[15] P. Lupini and V. Cuperman, "Non-square transform vector quantization for low-rate speech coding," in *Proc. IEEE Speech Coding Workshop,* (Annapolis, Md., USA), pp. 87–89, 1995.

[16] ITU-T, Telec. Stand. Sector, Geneva, Switzerland, *Test plan for the ITU-T* 4 *kbit/s speech coding algorithm,* September 1997.

[17] I. M. Trancoso, L. B. Almeida, and J. M. Tribolet, "A study on the relationships between stochastic and harmonic coding," in *Proc. IEEE Inter. Conf. Acoust., Speech, Sig. Process.,* pp. 1709–1712, 1986.

[18] M. Nishiguchi, K. Lijima, and J. Matsumoto, "Harmonic vector excitation coding of speech at 2.0 kpbs," in *Proc. IEEE Speech Coding Workshop,* (Pocono Manor, Pa., USA), pp. 39–40, 1997.

[19] W. R. Gardner and B. D. Rao, "Noncausal all-pole modeling of voiced speech," *IEEE Trans. Speech, Audio Process.,* vol 5, pp. 1–10, January 1997.

[20] X. Sun, F. Plante, B, M. G. Cheetham, and K. W. T. Wong, "Phase modeling of speech excitation for low bit-rate sinusodial transform coding," in *Proc. IEEE Intra Conf. Acoust., Speech, Sig. Process.,* pp. 1691–1694, 1997. Vol III.

[21] M. W. Macon and M. A. Clements, "Sinusodial modeling and modification of unvoiced speech," *IEEE Trans. Speech, Audio Process.,* vol. 5, pp. 557–560, September 1997.

[22] M. Nishiguchi and J. Matsumoto, "Harmonic and noise coding of LPC residuals with classified vector quantization," in *Proc. IEEE Intra. Conf. Acoust., Speech, Sig. Process.,* pp. 484–487, 1995.

[23] W. B. Kleijn, Y. Shoham, D. Sen, and R. Hagen, "A low-complexity waveform interpolation coder," in *Proc. IEEE Intra. Conf. Acoust., Speech, Sig. Process.,* pp. 212–215. 1996.

[24] S. Yeldener, A. M. Kondoz, and B. G. Evans, "High quality multiband LPC coding of speech at 2.4 kbit/s," *Electronic Letters,* vol. 27, pp. 1287–12889, July 1991.

[25] V. Cuperman, P. Lupini, and B. Bhattacharya, "Special excitation coding of speech at 2.4 kb/s," in *Proc. IEEE Intra. Conf. Acoust., Speech, Sig, Process.,* pp. 496–499, 1995.

[26] International Telecommunications Union, Draft Recommendation G.729, "coding of speech at 8 kbit/s using Conjugate Structure Algebraic Code Excited Linear Prediction (CS-ACELP), version 6.51, Feb. 5, 1996.

[27] W. P. LeBlanc, B. Bhattacharya, S. A. Mahmoud, and V. Cuperman, "Efficient search and design procedure for robust multi-stage VQ of LPC parameters for 4 kb/s speech coding," *IEEE Trans. Speech, Audio Process.,* vol. 1, pp. 373–385, October 1993.

[28] E. Shlomot, "Delayed decision switched prediction multi-stage LSF quantization," in *Proc. IEEE Speech Coding Workshop,* (Annapolis, Md., USA), pp. 45–46, 1995.

[29] K. K. Paliwal and B. S. Atal, "Efficient vector quantization of LPC parameters at 24 bits/frame," *IEEE Trans, Speech, Audio Process.,* vol. 1, pp. 3–14, January 1993.

[30] S. Wang and A. Gersho, "Phonetic segmentation for low rate speech coding," in *Advances in Speech Coding* (B.

S. Atal, V. Cuperman, and A. Gersho, eds.) Boston/Dordrecht/London: Kluwer Academic Publications, 1991.

[31] A. Das, E. Paksoy, and A. Gersho, "Multimode and variable-rate coding of speech," in *Speech Coding and Synthesis* (W. B. Kleijn and K. K. Paliwal, eds.), Amsterdam: Elsevier Science Publishers, 1995.

[32] A. Benyassine, E. Shlomot, H.-Y. Su, and E. Yuen, "A robust low complexity voice activity detection algorithm for speech communications systems." In *Proc. IEEE Speech Coding Workshop,* (Pocono Manor, Pa., USA), pp. 97–98, 1997.

[33] S. Haykin, *Neural Networks.* New York: Macmillan College Publishing Company, 1994.

[34] T. Wang, K. Tang, and C. Geng, "A high quality MBE-LPC speech coder at 2.4 kbps and 1.2 kbps," in *Proc. IEEE Intra. Conf. Acoust., Speech. Sig. Process.,* pp. 208–211. 1996. Vol. I.

[35] A. Das, A. V. Rao, and A. Gersho, "Variable dimension vector quantization," *IEEE Sig. Process. Letters,* vol. 3, pp. 200–202, July 1996.

[36] J. Thyssen, W. B. Kleijn, and R. Hagen, "Using a preception-based frequency scale in waveform interpolation," in *Proc. IEEE Intra. Conf. Acoust., Speech. Sig. Process.,* pp. 1595–1598, 1997.

[37] E. Shlomot, V. Cuperman, and A. Gersho, "Hybrid coding of speech at 4 kbps," in *Proc. IEEE Speech Coding Workshop,* (Pocono Manor, Pa., USA), pp. 37–38, 1997.

[38] I. S. Burnett and D. H. Pham, "Multi-prototype waveform coding using frame-by-frame analysis-by-synthesis," in *Proc. IEEE Intr. Conf. Acoust., Speech, Sig, Process.,* pp. 1567–1570, 1997.

[39] M. Schroeder and B. S. Atal, "Code-excited linear prediction (CELP): High-quality speech at very low bit rates," in *Proc. IEEE Intra. Conf. Acoust., Speech, Sig. Process.,* pp. 937–940, 1985.

[40] W. B. Kleijn, P. Kroon, D. Nahumi, "The RCELP speech-coding algorithm", *European Trans. on Telecommunications and Related Technologies,* Vol. 5, September-October 1994, pp. 573–582.

[41] W. B. Kleijn, R. P. Ramachandran, P. Kroon, "Generalized analysis-by-synthesis coding and its application to pitch prediction", *Proc. ICASSP'92,* Vol. 1, 1992, pp. 337–340.

[42] W. B. Kleijn, D. Nahumi, U.S. Pat. No. 5,704,003, "RCELP Coder."

[43] TIA Draft standard, TIA/EIA/IS-127, Enhanced Variable Rate Codec (EVRC), 1996.

BACKGROUND OF THE INVENTION

1. Field of the Invention

This invention pertains generally to speech coding techniques, and more particularly to hybrid coding of speech.

2. Description of the Background Art 2.1 Introduction

Speech compression plays an increasingly important role in modern communication systems, enabling speech information transmission and storage with limited bandwidth and memory resources. The speech compression method of Code Excited Linear Prediction (CELP) became the prevailing technique for high quality speech compression in recent years and was shown to deliver compressed speech of toll-quality down to rates close to 6 kbps [2]. CELP type coders are waveform coders, employing the Analysis-by-Synthesis (AbS) scheme within the excitation-filter framework for waveform matching of a target signal. However, the quality of CELP coded speech drops significantly if the bit rate is reduced below 4 kbps, while other speech coders, sometimes called "vocoders", deliver better speech quality at this low rate and were adapted for various applications. Vocoders are not based on the waveform coding paradigm but use a quantized parametric description of the target input speech to synthesize the reconstructed output speech. Low bit rate vocoders use the periodic characteristics of voiced speech and the "noise-like" characteristics of stationary unvoiced speech for speech analysis, coding and synthesis. Some early vocoders, such as the federal standard 1015 LPC-10 [3], use a time-domain analysis and synthesis method, but most contemporary vocoders utilize a harmonic spectral model for the voiced speech segments, and we call such vocoders "harmonic coders".

Harmonic coders excel at low bit rates by discarding the perceptually unimportant information of the exact phase, while waveform coders spend precious bits in preserving it. The work of Almeida and Tribolet [4], which replaced the harmonic measured phase with a "predicted" phase, introduced the general synthetic phase model which is the basis of practically all modern harmonic coders. Their work was followed by many other contributions, addressing the theoretical and practical issues of harmonic coding. A harmonic model in the excitation-filter framework, which is now commonly used in harmonic coding, was first suggested by Hedelin [5]. McAulay and Quatieri, in their many versions of the Sinusoidal Transform Coding (STC) scheme [6], addressed the problems of phase models, pitch and spectral structure estimation and quantization. They suggested a frequency domain model for stationary unvoiced speech, based on dense frequency sampling and phase randomization, and showed the importance of overlap-and-add for signal continuity. Griffin and Lim [7] introduced Multi-Band Excitation (MBE) coding which uses multiple harmonic and non-harmonic (noise-like) bands. The low complexity Improved MBE (IMBE) was selected as a speech coding standard for satellite communication [8]. Also of importance are Kleijn's Prototype Waveform Interpolation (PWI) family of low bit rate coders [9] and Shoham's Time Frequency Interpolation (TFI) coder [10]. These coding schemes are based on interpolating a pitch prototype waveform over a frame, which is performed using a harmonic representation. Both schemes operate on the residual signal, which is particularly suitable for harmonic analysis and coding, and some earlier versions of these coders use a time domain coding scheme for the representation of unvoiced speech. In an early version of the PWI coder, Kleijn [9] indicated the use of synchronization for signal continuity between prototype coded voiced frames and waveform coded unvoiced frames, but the specific techniques were not given. The newly adopted federal standard for secure communication employs the Mixed Excitation Linear Prediction (MELP) coder introduced by McCree and Barnwell [11], which operates on the residual signal and uses the Fourier spectral representation for voiced speech segments.

Efficient quantization of the harmonic spectral magnitudes is a crucial part of every harmonic coding scheme. The dimension of the vector of spectral magnitudes varies with the pitch frequency, prohibiting direct application of vector quantization (VQ). Instead, VQ can be used if the variable dimension vector of spectral magnitudes is first converted into a fixed dimension vector which is then quantized. Examples of dimension conversion schemes are the nonlinear scheme of Discrete All Pole (DAP) modeling [12], or the linear schemes, such as bandlimited interpolation [13], Variable Dimension Vector Quantization (VDVQ) [14] or the Non-Square Transforms (NST) [15].

The objective of the new generation of speech coders is to achieve toll-quality speech at the rate of 4 kbps [16]. CELP type coders deliver toll-quality of speech at higher rates and harmonic coders produce highly intelligible and communication quality of speech at lower rates. However, at rates around 4 kbps both coding schemes face difficulties in delivering toll-quality speech. On one hand, CELP coders cannot adequately represent the target signal waveform at rates under 6 kbps, and on the other hand, additional bits for the harmonic model quantization do not significantly increase the speech quality at 4 kbps.

One of the reasons the speech quality of harmonic coders does not improve as the rate increases is the failure of either the harmonic or the noise models for important portions of the speech signal. Referring to FIG. 1A and FIG. 1B, we can see vowel segments which have strong periodic characteristics and fricative segments which have a stationary "noise-like" characteristics, but we can also clearly observe transition segments, which are neither periodic nor "noise-like". These segments, such as onsets, plosives, and non-periodic glottal pulses, consist of local time events which cannot be represented by the harmonic or the noise models (or even a combination of both). Previous work which uses a frequency domain coder for voiced speech and a time-domain coder for other classes of speech could be found in Trancoso et al [17], Shoham [10], Kleijn [9] and Nishiguchi et al [18]. However, these coders employ the voiced/unvoiced two class model without a special mode designed for handling transition segments, which we have shown to be particularly effective for high quality coding of speech.

2.2 Harmonic Coding

In this section we review some fundamental and practical issues in harmonic coding. The review is general, and most harmonic coders presented in the literature follow the basic scheme we present here, despite some implementation differences. Special effort was made in this review to bridge, rather than contrast, the different approaches used for harmonic coding.

2.2.1 Harmonic Structure of Voiced Speech

Voiced speech, generated by the rhythmic vibration of the vocal cords as air is forced out from the lungs, can be described as a quasi-periodic signal. Although the voiced speech is not a perfectly periodic signal, it displays strong periodic characteristics on short segments which include a number of pitch periods. The length of such segments depends on the local variations of the pitch frequency and the vocal tract. The time-domain periodicity implies a harmonic line spectral structure of the spectrum. FIG. 2A shows a typical segment of a female voiced speech, FIG. 2B shows the speech residual (obtained by inverse filtering using a linear prediction filter), and FIG. 2C and FIG. 2D show their corresponding windowed magnitude spectrum obtained by a 2048 point DFT, respectively. Time-domain multiplication by a window corresponds to a frequency-domain convolution of the harmonically related line-frequencies with the window spectrum. Note the enhanced harmonic structure of the residual signal at high frequencies compared to the original speech signal. The side-lobe interference from the spectral window convolved with the strong harmonics is much smaller for the residual signal due to the lower variability of the peak magnitudes. This improves the harmonic structure for the weak portions of the spectrum of the residual signal.

The frequency-domain convolution with the window spectrum preserves the line-frequency information at the harmonic peaks at the multiples of the pitch frequency, whereas other samples either convey the information about the main lobe of the window, or are negligibly small. Therefore the harmonic samples at the multiples of the pitch frequency can be used as a model for the representation of voiced speech segments. Harmonic spectral analysis can be obtained using a pitch synchronized DFT, assuming the pitch interval is an integral multiple of the sampling period [9], or by a DFT of a windowed segment of the speech which includes more than one pitch period. Since both methods are conceptually equivalent, and differ only in the size and the shape of the window used, we will address them at the same framework. Assuming that the pitch frequency, $f_p$, does not change during the spectral analysis frame, the spectral peak at each multiple of the pitch frequency (indexed by k) can be represented as a harmonic oscillator $$O_k^h(t)=a_k^h \cos(k2\pi f_p t+\phi_k^h), \tag{1}$$

where $a_k^h$ are the DFT measured magnitudes and $\phi_k^h$ are the DFT measured phases at the harmonic peaks (h stands for harmonic). The measured spectral samples at the multiples of the pitch frequency can be taken as the value of the nearest bin of a high resolution DFT. The harmonic speech can then be synthesized using a sum of all the harmonic oscillators $$r(t) = G\sum_k O_k^h(t) = G\sum_k a_k^h \cos(k2\pi f_p t + \phi_k^h), \tag{2}$$

where G is an energy normalization factor which depends on the DFT size and the type of window used. The number of spectral peaks, and hence the number of oscillators, varies with the pitch frequency and is inversely proportional to it. FIG. 3A shows a 40 ms segment of female voiced speech. FIG. 3B depicts the reconstruction of the speech segment from only 16 harmonic samples of a 512 point DFT, using both magnitude and phase. Note the faithful reconstruction of the waveform using only the partial harmonic information of the spectrum.

FIG. 3C demonstrates speech harmonic reconstruction using magnitude only, i.e., setting $\phi_k^h=0$ for all k. The harmonic component of the phase, given by $2\pi f_p t$, generates a periodic signal with a period of $$\frac{1}{f_p},$$

an epoch at t=0 and a symmetrical structure around the epochs. The term "epoch" is used to refer to a point of energy concentration associated with a glottal pulse as approximated by the model. From the waveform difference between FIG. 3B and FIG. 3C it is evident that the DFT measured phases govern two aspects of the speech waveform. First, they control the location of the pitch epochs, and second they define the detailed structure of the pitch pulse. Hence, the DFT measured phase, $\phi_k^h$, can be broken into two terms: a constant linear phase $k\theta_0$, and a dispersion phase $\psi_k^h$. The linear phase introduces a time shift which places an epoch of r(t) at $$\frac{\theta_0}{2\pi f_p},$$

while the dispersion phase breaks the pulse symmetry around its epochs. Each harmonic oscillator now has the form:

$$O_k^h(t)=a_k^h \cos(k\theta_0+k2\pi f_p t+\psi_k^h). \quad (3)$$

The full phase, which is the argument of the cos(•) function, consists now of three terms: the linear phase $k\theta_0$, the harmonic phase $k2\pi f_p t$, and the dispersion phase $\psi_k^h$. The linear and the harmonic phases of all oscillators are related by the index k and involve only two parameters, namely $\theta_0$ and $f_p$, whereas the dispersion phase is has a distinct value for each peak. This three term structure of the phase emphasizes the distinct role of each phase component and will serve in understanding the practical schemes for harmonic coding.

The description above does not take into account the pitch variations, signal continuity between frames, and the problems involved in representing the large number of phase parameters. These issues are addressed in section 2.2.3, where we describe a practical approach for harmonic synthesis which employs a synthetic phase interpolation model and an overlap-and-add amplitude smoothing technique.

2.2.2 Spectral Structure of Unvoiced and Mixed Signals

The spectral structure of stationary unvoiced speech for sounds such as fricatives, which are generated by turbulence in the air flow passage, is clearly non-harmonic. The spectral structure of a voiced segment can also be non-harmonic at some portions of the spectrum, mainly in the higher spectral bands, as a result of mixing of glottal pulses with air turbulence during articulation. A signal with a mixture of harmonic and non-harmonic bands is called a "mixed signal".

Smearing of the harmonic structure can be also the result of local waveform variability and pitch frequency variations within the spectral analysis window. However, proper choice of the size of the spectral analysis window can help in reducing this effect. FIG. 2A through FIG. 2D demonstrate that some harmonic blurring can also come from energy leakage of the side-lobes of the window spectrum, but this phenomenon is less severe for the spectrum of the residual signal than for the spectrum of the speech signal.

The non-harmonic spectral bands can be modeled by band-limited noise, and many harmonic coders use band-limited noise injection for the representation of these bands. Some vocoders use a detailed description of the harmonic and the non-harmonic structure of the spectrum [7]. However, recent studies have suggested that it is sufficient to divide the spectrum into only two bands: a low harmonic band and a high non-harmonic band [13]. The width of the lower harmonic band is denoted the "harmonic bandwidth". The value of the harmonic bandwidth can be as high as half of the sampling frequency, indicating a fully-harmonic spectrum, and can go down to zero, indicating a completely stationary unvoiced segment such as a fricative sound.

2.2.3 Practical Harmonic Synthesis

The harmonic synthesis model of Eq. (3) is valid only for short speech segments, where the pitch and the spectrum are constant over the synthesis frame. It also does not provide signal continuity between neighboring frames, since simple concatenation of two frames with different pitch values will result in large discontinuity of the reconstructed speech which can be perceived as a strong artifact. Other problems with this model are the large number of parameters needed for signal reconstruction and their quantization, in particular the quantization of the measured phases.

Almeida and Tribolet [4] introduced the important concept of "predicted" phase, which we will call "synthetic" phase. The synthetic phase model is simply the integral over time of the time-dependent pitch frequency:

$$\theta(t) = \theta_0 + 2\pi \int_{t_0}^{t} f_p(\tau)d\tau, \quad (4)$$

where $\theta_0=\theta(t_0)$ is the phase at $t_0$. With this phase model, each of the oscillators is given by $$O_k^h(t) = a_k^h \cos[k\theta(t)] = a_k^h \cos\left[k\theta_0 + k2\pi \int_{t_0}^{t} f_p(\tau)d\tau\right]. \quad (5)$$

The synthetic phase model replaces the exact linear phase, which synchronizes the original and the reconstructed speech, by a modeled linear phase. The harmonic phase component is replaced by the integral of the pitch frequency, which incorporates the pitch frequency variations into the phase model. However, the model discards the individual dispersion phase term of each oscillator, which results in a reconstructed signal which is almost symmetric around its maxima (assuming the pitch frequency deviation is small). Note that if we assume a constant pitch frequency, the linear and harmonic components of the synthetic phase of Eq. (5) coincide with the linear and harmonic components of the three term representation of Eq. (3).

This phase model seems to agree well with the human auditory system, which is insensitive to the absolute linear phase and tolerates an inaccurate or an absent dispersion phase, but is sensitive to the pitch frequency and phase continuity. These perceptual properties, as well as the bit rate reduction obtained by eliminating the phase information, play an important role in the success of the harmonic models at low bit rates.

Parametric models for the representation of the dispersion phase were introduced, for example, by Gardner [19], and by Sun [20]. A simple model for the dispersion phase was also investigated at an early stage of our codec development, but its contribution to the speech quality seemed to be small and this topic requires further research.

Since measurements of the pitch frequency are obtained and transmitted on discrete time instances spaced by the pitch sampling interval T, the continuous argument for the integral in Eq. (4) is approximated by an interpolation procedure. Linear interpolation of the pitch frequency with respect to the time yields a quadratic formula for the phase:

$$\theta(t) = \theta_0 + 2\pi\left[f_{i-1}t + \frac{1}{2T}(f_i - f_{i-1})t^2\right], \quad (6)$$

where and $f_{i-1}$ and $f_i$ are the previous and the current pitch frequencies, respectively. While the initial phase for each frame is the accumulated phase from the previous frame, the initial linear phase used at the first frame of a voiced speech segment (at the onset) must be chosen. This initial phase will determine the displacement of the whole reconstructed voiced segment with respect to the original signal. In the sequel we address the important issue of initial phase selection.

Several noise models can be used to represent the non-harmonic spectral band. We use the dense spectral magnitude sampling and random phase model suggested by McAulay and Quatieri [6], in which the non-harmonic portion of the spectrum is synthesized by a set of oscillators, each given by:

$$O_l^n(t)=a_l^n \cos(2\pi f_l^n t+\phi_l). \tag{7}$$

$\{f_l^n\}$ is a set of densely spaced frequencies in the non-harmonic spectral band and the set $\{a_l^n\}$ represents the sampled spectral magnitudes at these frequencies (n stands for noise). The random phase term $\phi_l$ is uniformly distributed on the interval $[0,2\pi)$. Note that if the synthesis frame size is L and the set of sampling frequencies is harmonically related with a spacing $\Delta f$, the relation $\Delta fL<1$ must be satisfied to avoid introducing periodicity into the noise generator. Macon and Clements [21] suggested breaking a large frame into several small ones to achieve that goal.

The reconstructed speech signal is synthesized by the summation over all harmonic and non-harmonic oscillators:

$$r(t) = G_1\sum_k O_k^h(t) + G_2\sum_l O_l^n(t). \tag{8}$$

The model for the signal r(t) incorporates a synthetic phase model, derived from interpolating the pitch frequencies from the beginning to the end of the interval. However, spectral magnitude interpolation is also required to provide signal smoothing between each two neighboring frames, and can be carried out using an overlap-and-add between the first and the second frame. Overlap-and-add requires the coincidence of the pitch epochs on the common interval of the first and the second frame, which can be obtained using the following procedure. Let $r_1(t)$ be the reconstructed signal using the spectral magnitudes representation of the first frame, and the interpolated phase model derived from the pitch values of the first and the second frame. Let $r_2(t)$ be the reconstructed signal from the spectral magnitudes representation of the second frame and the same interpolated phase which was used for $r_1(t)$. Using the same phase model for the common interval of $r_1(t)$ and $r_2(t)$ ensures the pitch epochs coincidence between both signals which is crucial for signal smoothing using the overlap-and-add procedure. The smoothed signal r(t), which is the reconstructed signal on the overlapped interval between the first frame and the second frame is given by:

$$r(t)=w(t)r_1(t)+[1-w(t)]r_2(t). \tag{9}$$

Assuming the harmonic bandwidth is equal to half of the sampling frequency (no noise components), the overlap interpolation formula takes the form:

$$r(t) = G\sum_k [w(t)a_k^h + [1 - w(t)]b_k^h]\cos [k\theta + (t)], \tag{10}$$

where $\{a_k^h\}$ and $\{b_k^h\}$ are the measured DFT magnitudes of the first and the second frame, respectively. The overlap-and-add window function w(t) is in most cases a simple triangular window. Note that the spectral magnitudes of each frame are first used to generate the signal in the overlapped interval with the preceding frame and then are used again to generate the signal in the overlapped interval with the following frame. However, different phases are used for each interpolation. The interpolation with the preceding frame incorporates into the phase model the pitch frequency evolution from the preceding frame to the current one, whereas the interpolation from the current frame to the following frame incorporates into the phase model the pitch frequency evolution from the current frame to the following frame.

The calculation of the sum of oscillators in Eq. (8) is a computationally intensive procedure, but for short frames and for small variations of the pitch frequency over the frame, it can be approximated by an IDFT [6] combined with an overlap-and-add. The oversampled IDFT and time samples interpolation approach of Nishiguchi et al [22] or Kleijn et al [23], combined with an overlap-and-add, provides an excellent approximation and reduced complexity for the magnitude and phase interpolation scheme.

The target signal for harmonic coding can be the original speech, such as used by STC [6] and IMBE [7], but it can also be the residual signal, used by the TFI [10], the PWI [9], the Multiband LPC Coding [24], or the Spectral Excitation Coding (SEC) [25]. Three reasons can be brought forward for preferring the residual signal over the original speech as the target signal for harmonic coding. First, as was demonstrated by FIG. 2A through FIG. 2D, the residual signal displays an enhanced harmonic structure due to the reduced leakage of side-lobes energy from high level harmonics into low-level harmonics. Second, the phase response of the LP synthesis filter serves as a phase dispersion term, compensating for the lack of dispersion phase in the synthetic phase model used for the residual signal. And third, the efficient quantization of the LP parameters, using the LSF representation, may be considered as an initial stage of rough quantization for the spectrum which eases the quantization of the harmonic spectral envelope.

BRIEF SUMMARY OF THE INVENTION

To overcome the harmonic coder limitations which are inherent to the voiced/unvoiced model, the present invention introduces a third coding model for the representation of the transition segments to create a hybrid model for speech coding. In accordance with the present invention, the speech signal is classified into steady state voiced (harmonic), stationary unvoiced, and "transitory" or "transition" speech, and a suitable type of coding scheme is used for each class.

The three class scheme is very suitable for the representation of all types of speech segments. Harmonic coding is used for steady state voiced speech, "noise-like" coding is used for stationary unvoiced speech, and a mixture of these two coding schemes can be applied to "mixed" speech, which contains both harmonic and non-harmonic components. Each of these coding schemes can be implemented in the frequency or the time domain, independently or combined. A special coding mode is used for transition speech, designed to capture the location, the structure, and the strength of the local time events that characterize the transition portions of the speech.

By way of example, and not of limitation, a hybrid speech compression system in accordance with the present invention uses a harmonic coder for steady state voiced speech, a "noise-like" coder for stationary unvoiced speech, and a special coder for transition speech. The invention generally comprises a method and apparatus for hybrid speech compression where a particular type of compression is used depending upon the characteristics of the speech segment. The compression schemes can be applied to the speech signal or to the LP residual signal. The hybrid coding method of the present invention can be applied where the voiced harmonic coder and the stationary unvoiced coders operate on the residual signal, or they can alternatively be implemented directly on the speech signal instead of on the residual signal. Hybrid encoding in accordance with the present invention generally comprises the following steps:

1. LP analysis is performed on the speech and then the residual signal is obtained by inverse LP filtering with filter parameters determined by the LP analysis.

2. Class, pitch and harmonic bandwidth are determined based on speech and residual parameters. In this regard, the term "harmonic bandwidth" is used to denote the cutoff frequency below which the spectrum of the speech segment is judged to be harmonic in character (having a sequence of harmonically located spectral peaks) and above which the spectrum is judged to be irregular in character and lacking a distinctive harmonic structure.

3. Switching at frame boundaries (according to the class decision for the current frame to be encoded) between three possible coders:

(a) A harmonic coder for voiced speech.

(b) A "noise-like" coder for stationary unvoiced speech (can be combined with the voiced coder to represent "mixed" speech).

(c) A coder for transition speech.

4. On switching from the transition coder to the voiced coder (voicing onset), signal synchronization is achieved by selecting a linear phase component which maximizes a continuity measure on the frame boundary.

5. On switching from the voiced coder to the transition coder (voicing offset), signal synchronization is achieved by changing the frame reference point by maximizing a continuity measure on the frame boundary.

Combining the special coding mode for the transition speech with the harmonic coding for steady state voiced speech necessitates the development of phase synchronization modules for the reconstruction of the linear phase term, which provides continuous signal when switching between the different modes. Since no phase information is needed for the reconstruction of a "noise-like" speech, synchronization is not needed when switching to or from this mode, and the linear phase can be reset for this mode. Coding robustness by masking of classification errors is also improved, since the additional mode can represent, with acceptable quality, harmonic and noise-like speech as well.

An object of the invention is to overcome the harmonic coder limitations which are inherent to the voiced/unvoiced model.

Another object of the invention is to introduce a third coding model for the representation of the transition segments to create a hybrid model for speech coding.

Another object of the invention is to classify a speech signal into steady state voiced (harmonic), stationary unvoiced, and "transitory" or "transition" speech.

Another object of the invention is to use a three class coding scheme, where a suitable coding scheme is used for each class of speech.

Another object of the invention is to use harmonic coding for steady state voiced speech, "noise-like" coding for stationary unvoiced speech, and a mixture of these two coding schemes for "mixed" speech which contains both harmonic and non-harmonic components.

Another object of the invention is to implemented coding schemes in the frequency or the time domain, independently or combined.

Another object of the invention is to use a special coding mode for transition speech, designed to capture the location, the structure, and the strength of the local time events that characterize the transition portions of the speech.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 2B shows the residual for the waveform shown in FIG. 2A, and FIG. 2C and FIG. 2D show the spectral magnitudes for the speech and residual signals, respectively.

FIG. 3A depicts a 40 ms segment of original speech, FIG. 3B depicts reconstruction from 16 harmonic peaks using magnitude and phase, and FIG. 3C depicts reconstruction from 16 harmonic peaks using magnitude only.

FIG. 6A depicts 60 ms of the original residual of an onset segment, FIG. 6B depicts the reconstructed non-synchronized excitation using $\theta_0=0$, and FIG. 6C depicts the reconstructed synchronized excitation using estimated $\theta_0$.

FIG. 7A depicts 60 ms of the original residual of an offset segment, FIG. 7B depicts non-synchronized excitation without reference shift, and FIG. 7C depicts synchronized excitation using a shifted reference transition segment.

DETAILED DESCRIPTION OF THE INVENTION

For illustrative purposes the present invention is described with reference to FIG. 4A through FIG. 12. It will be appreciated that the apparatus may vary as to configuration and as to details of the parts and that the method may vary as to the specific steps and their sequence without departing from the basic concepts as disclosed herein.

1. General Structure of Hybrid Speech Coder

Figure 1A:
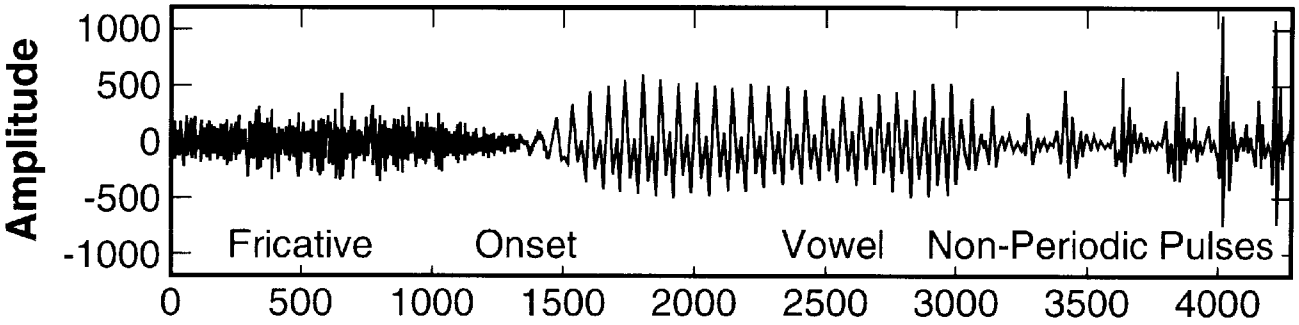
FIG. 1A and FIG. 1B show examples of speech waveforms.
Figure 1B:
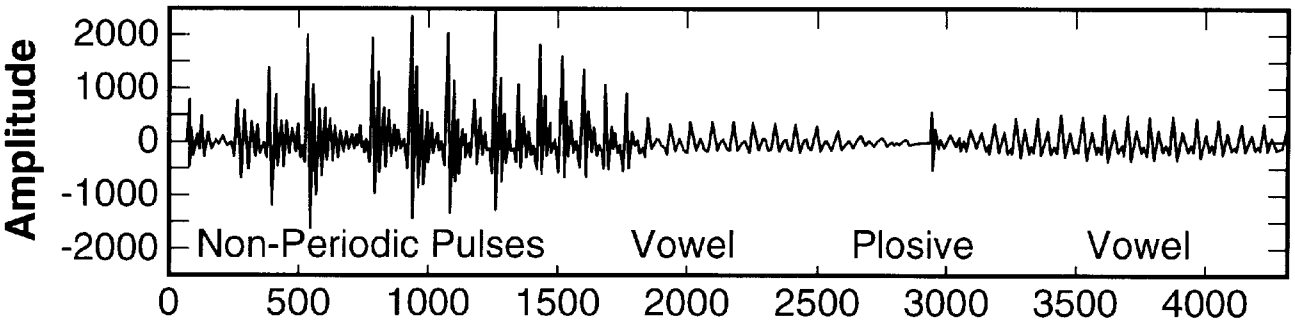
Figure 2A:
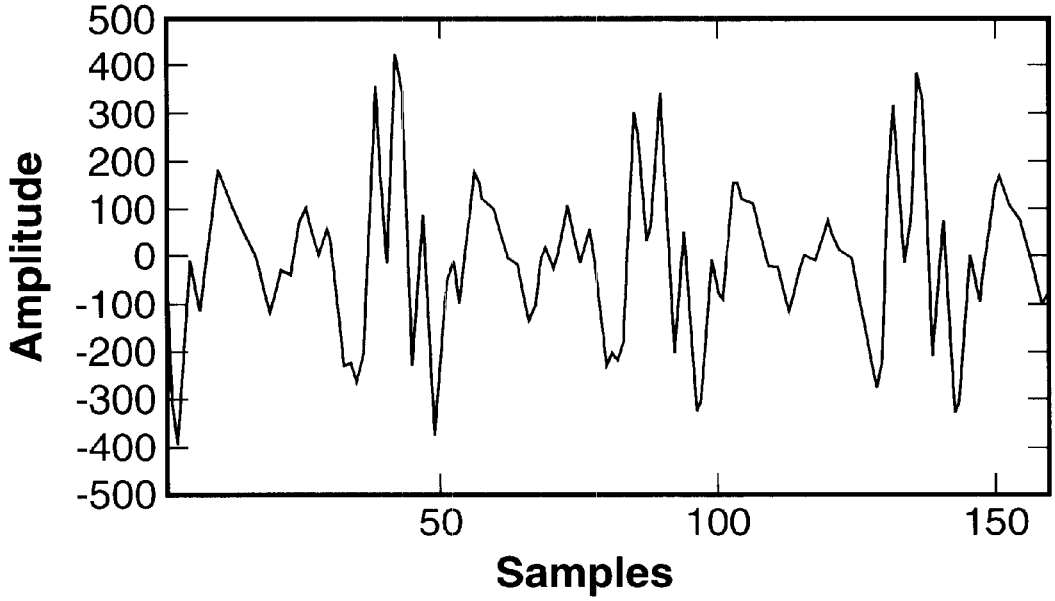
FIG. 2A through FIG. 2D show examples of waveform and spectral magnitude plots of speech and residual signals.
Figure 2B:
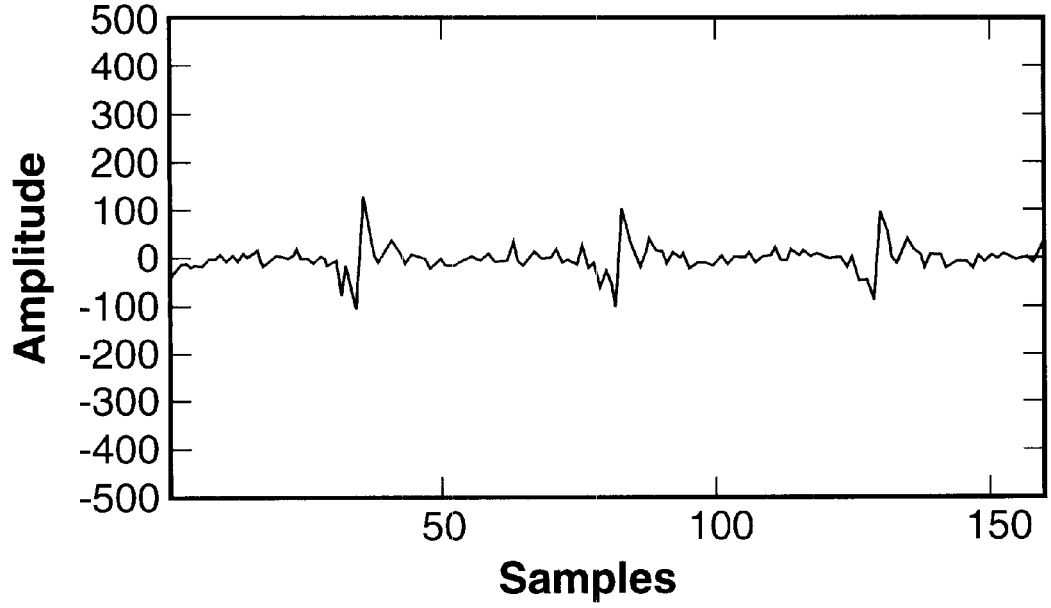
Figure 2C:
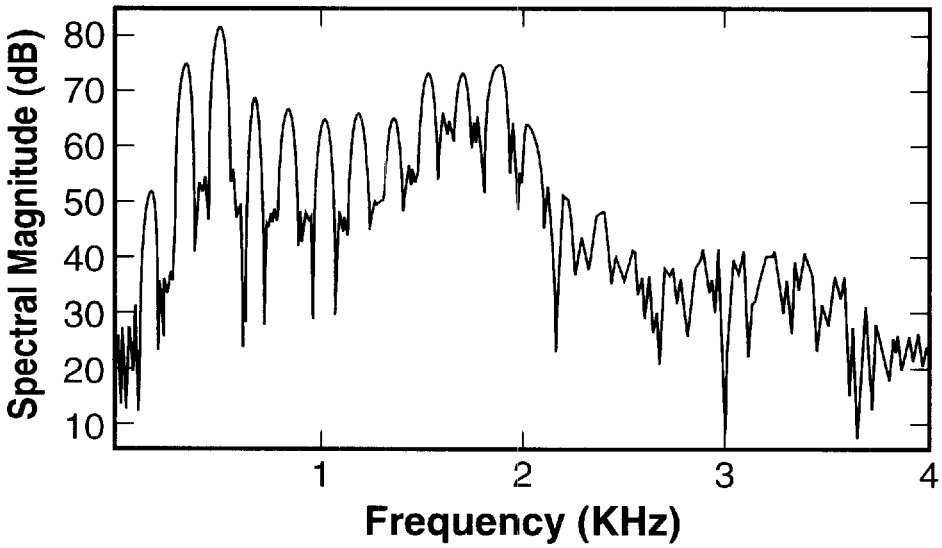
Figure 2D:
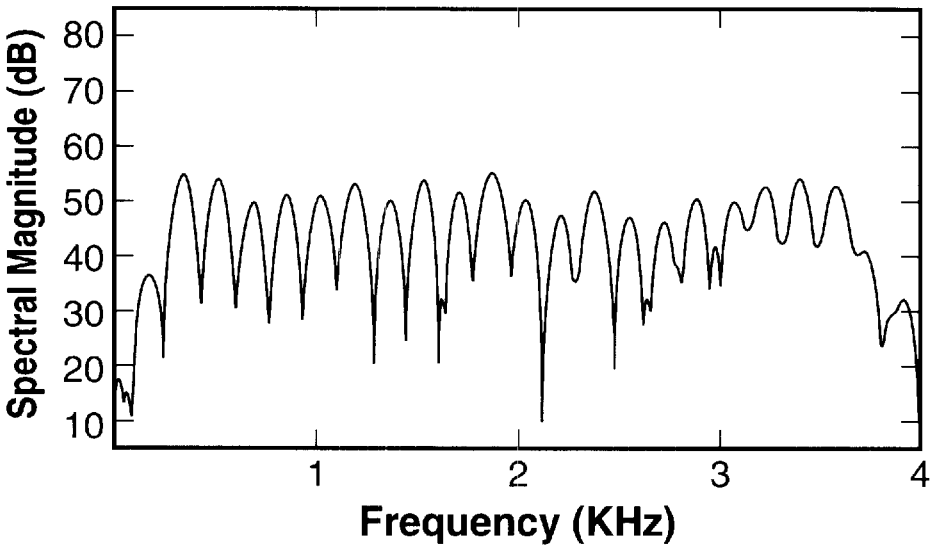
Figure 3A:
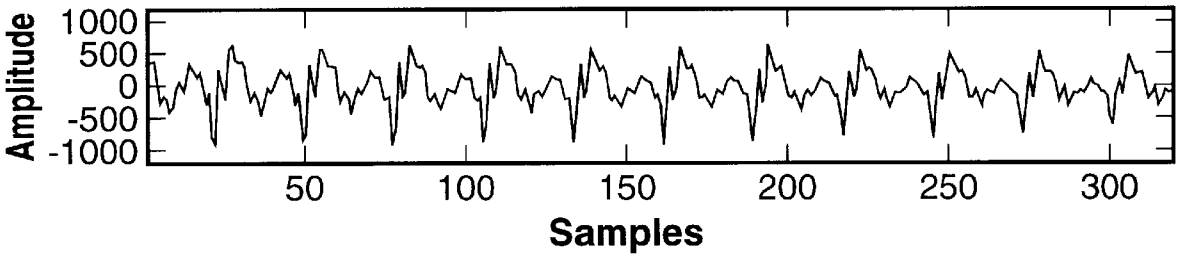
FIG. 3A through FIG. 3C show examples of waveforms that demonstrate the role of phase in harmonic reconstruction of speech.
Figure 3B:
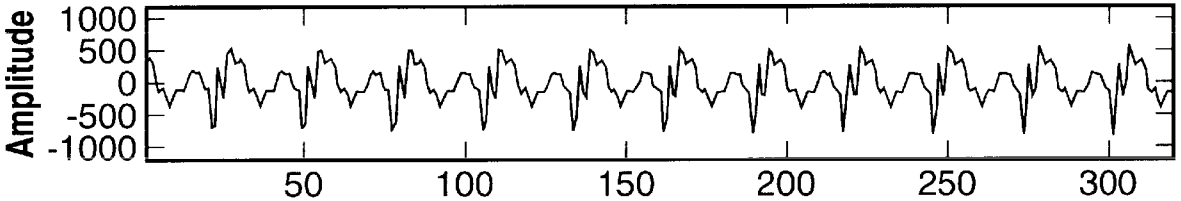
Figure 3C:
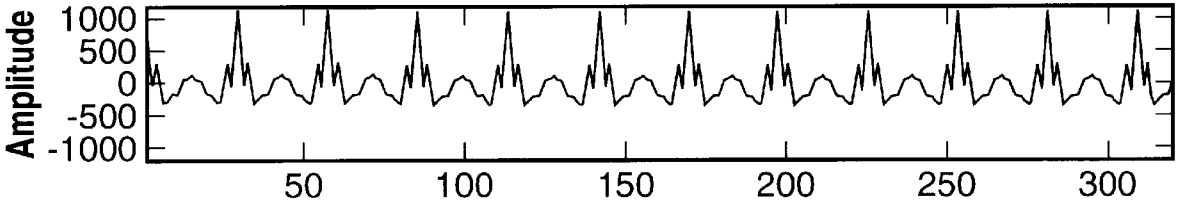
Figure 4A:
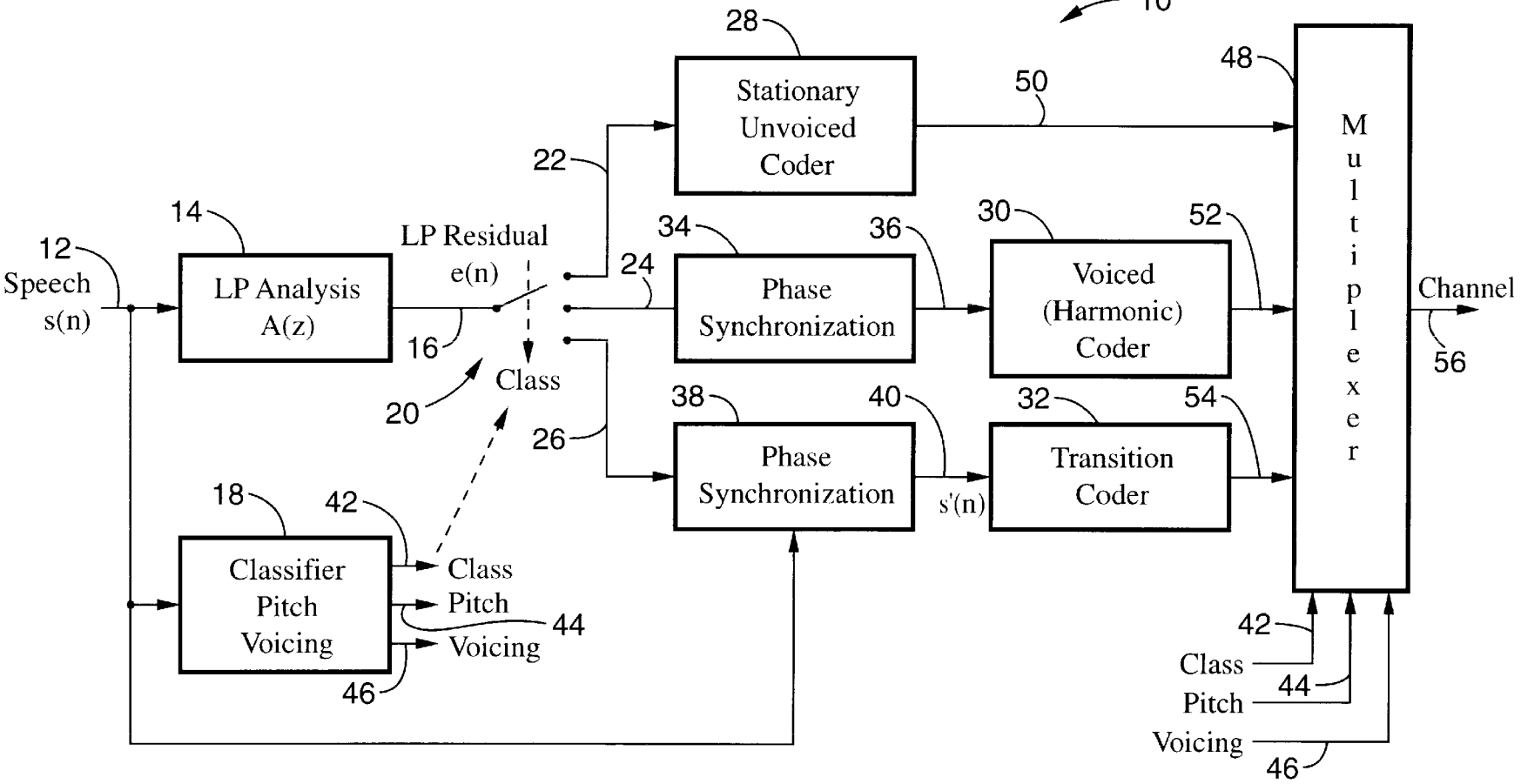
FIG. 4A through FIG. 4D are functional block diagrams of a hybrid encoder in accordance with the present invention.

Referring to first FIG. 4A, a functional block diagram an embodiment of a hybrid encoder 10 in accordance with the present invention is shown. In accordance with the present invention, the speech signal is classified into steady state voiced (harmonic), stationary unvoiced, and "transitory" or "transition" speech, and a suitable type of coding scheme is used for each class. While three classes are described in the preferred embodiment of the invention, the coding method is readily generalized to more than three classes. For example, the voiced class can readily be subdivided into several classes with a customized version of the harmonic coder applied to the residual (or speech signal) that is tailored to each class. In addition, while the preferred embodiment described herein shows the voiced harmonic coder and the stationary unvoiced coder operating on the residual signal, it will be appreciated that the hybrid encoder can alternatively operate directly on the speech signal instead of the residual signal.

In FIG. 4A, a speech signal 12 undergoes Linear Prediction (LP) analysis by LP module 14 and the residual signal 16 is obtained by inverse LP filtering. The LP parameters are estimated using well-known methods and are quantized using the Line Spectral Frequencies (LSFs) representation and employing vector quantization (VQ) [27]. For every frame, a speech classifier/pitch/voicing (CPV) module 18 classifies the speech as stationary unvoiced, steady-state voiced (harmonic), or transition speech. The resultant classification is then used to control a switch 20 to route the LP residual 16 to an input line 22, 24, 26 associated with a corresponding stationary unvoiced coder 28, a voiced coder 30, or a transition coder 32, respectively. Note that input line 24 is coupled to a phase synchronization module 34, the output 36 of which is coupled to voiced coder 30, and that input line 26 is coupled to phase synchronization module 38, the output 40 of which is coupled to transition coder 32. Phase synchronization modules 34, 38 are employed to provide maximal speech continuity when switching from the transition coder 32 to the voiced coder 30 or from the voiced coder 30 to the transition coder 32. With regard to phase synchronization module 38, note that the output to the transition coder 32 is typically a time shifted version of the input signal, s'(n), of the input signal, s(n), and not the LP residual as in the case of phase synchronization module 34.

For voiced speech, a pitch detector within CPV module 18 detects the pitch frequency and a harmonic bandwidth estimator within CPV 18 estimates the frequency range mixture (voicing) needed between voiced and unvoiced components. Classification data 42, pitch data 44 and voicing data 46 are also sent to a multiplexer 48 which multiplexes that data with the corresponding outputs 50, 52, 54 of the stationary unvoiced, voiced and transition coders (e.g., corresponding speech frames), respectively, for transmission over a data channel 56. Accordingly, the quantized LP parameters, the class decision and the quantized parameters of the appropriate coder are sent to the decoder.

Figure 4B:
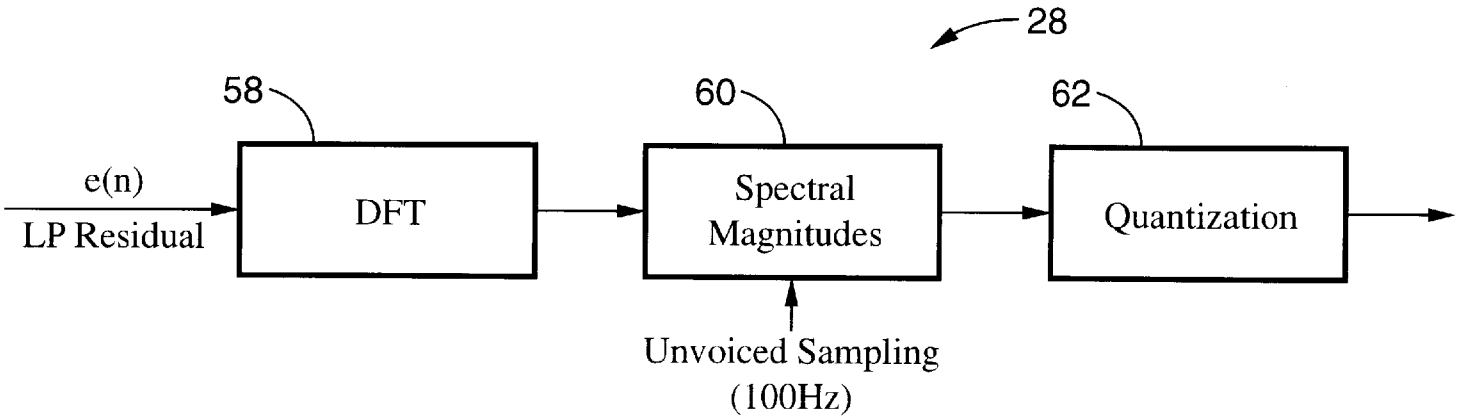
Figure 4C:
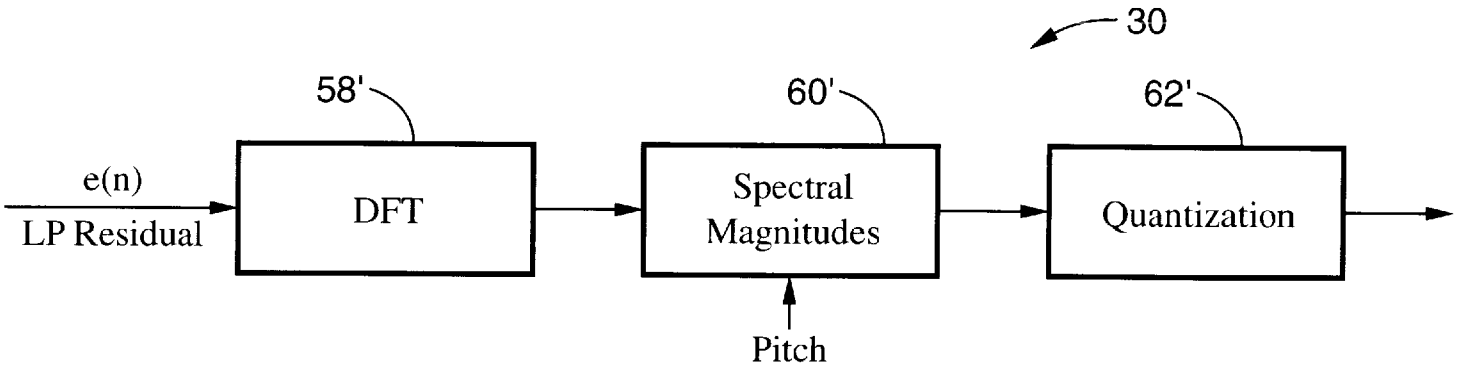
Figure 4D:
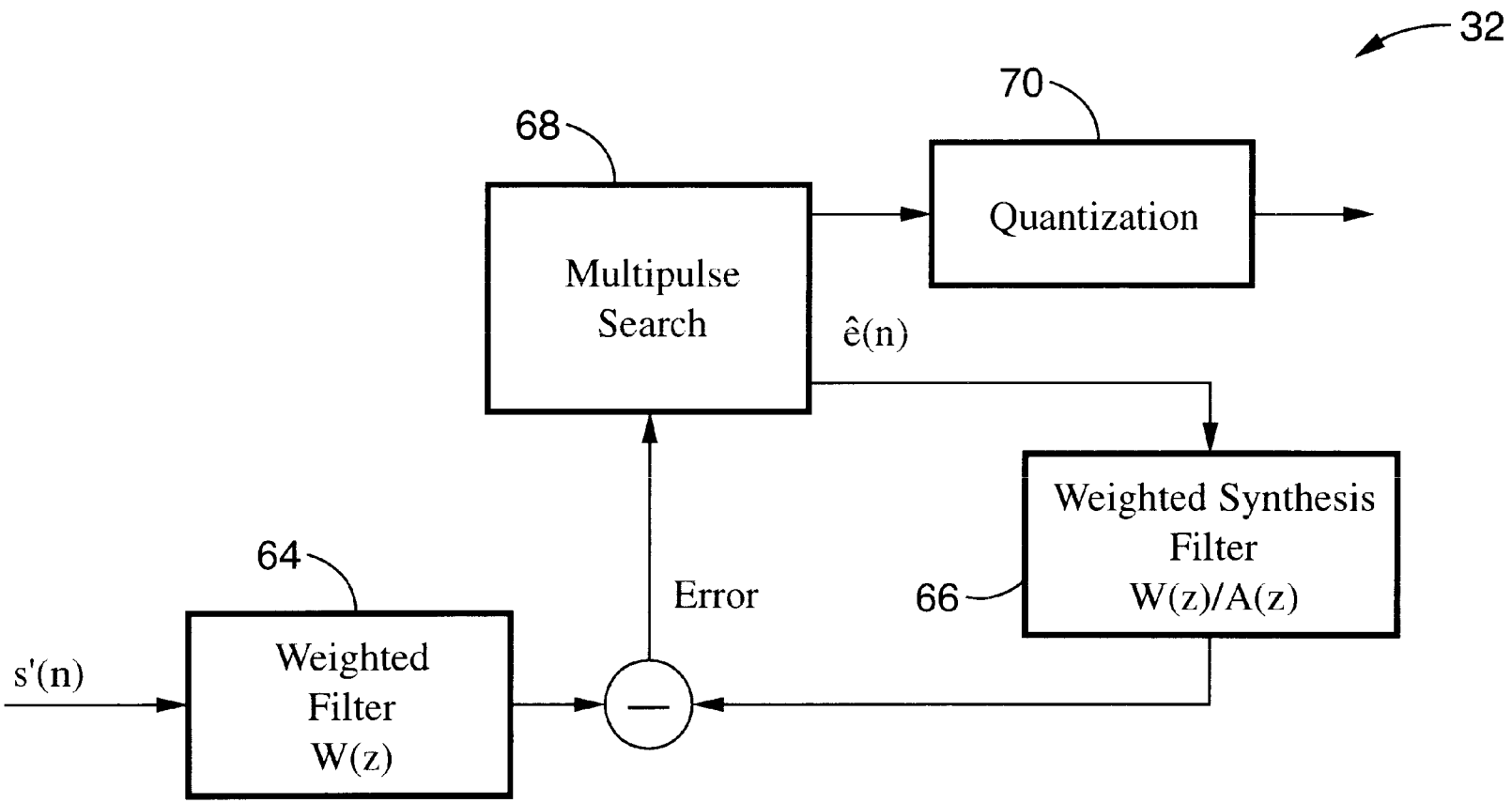

Referring also to FIG. 4B, FIG. 4C and FIG. 4D, functional block diagrams of the stationary unvoiced coder, voiced coder and transition coder, respectively, are shown. Unvoiced and voiced speech are modeled and coded in the frequency domain, as shown in FIG. 4B and FIG. 4C, respectively. Starting with a windowed discrete Fourier transform (DFT) 58, 58', samples 60, 60' of the spectral magnitudes are then obtained. Samples at harmonics of the pitch frequency are obtained for voiced speech, and dense sampling and averaging is performed on unvoiced speech. The averaging operation simply takes the average of the DFT spectral magnitudes in the neighborhood of each spectral sampling point to obtain the value of the spectral sample to be quantized. The width of the neighborhood is equal to the spacing between samples. The frequency samples are quantized, employing dimension conversion, perceptual weighting, and structured VQ 62, 62'. Harmonic speech is synthesized using the quantized harmonic magnitudes and a harmonic phase that is obtained from a trajectory of the pitch frequency. The synthesis is given by Eq. (8) using the phase expression given by Eq. (6) and with a discrete time variable, n, replacing the continuous time variable, t, in these equations. Unvoiced speech is synthesized using the dense set of sampled magnitudes and random phases. For mixed-voiced segments, the amount of voiced and unvoiced component is controlled by the harmonic bandwidth.

In the case of transition segments, an analysis-by-synthesis waveform matching coder is used as shown in FIG. 4D. Signal s'(n) undergoes weighted filtering 64, weighted synthesis filtering 66, a multipulse search 68, and quantization 70. For the representation of transition segments the preferred embodiment uses a multipulse excitation scheme, which is particularly suitable to describe the local time events of onset, plosives and aperiodic glottal pulses. In most cases the multipulse excitation can also represent periodic glottal pulses and to some degree also produce a noise-like excitation, thus providing model overlap and increasing the coding robustness to classification errors.

Note that the design of the coding scheme for the transition segments must take into account the local time events characteristic of the transition signal. Combining waveform coding for the representation of unvoiced speech with harmonic coding for voiced speech was suggested by Trancoso et al [17], Shoham [10], Kleijn [9] and Nishiguchi et al [18]. However, those coders cannot differentiate between stationary unvoiced speech and transition speech and do not address the problems of proper classification and the design of a specialized coding model for each of these distinct classes. For example, a waveform coder designed for stationary unvoiced speech will use random noise vectors for representing the excitation, but that representation would not be suitable for transition frames. An aperiodic flag is used by the MELP coder [11] to distinguish between harmonic and non-harmonic pulses, but a speech segment which contains non-harmonic pulses is only one case of transition frame which requires the use of a special model.

Figure 5:
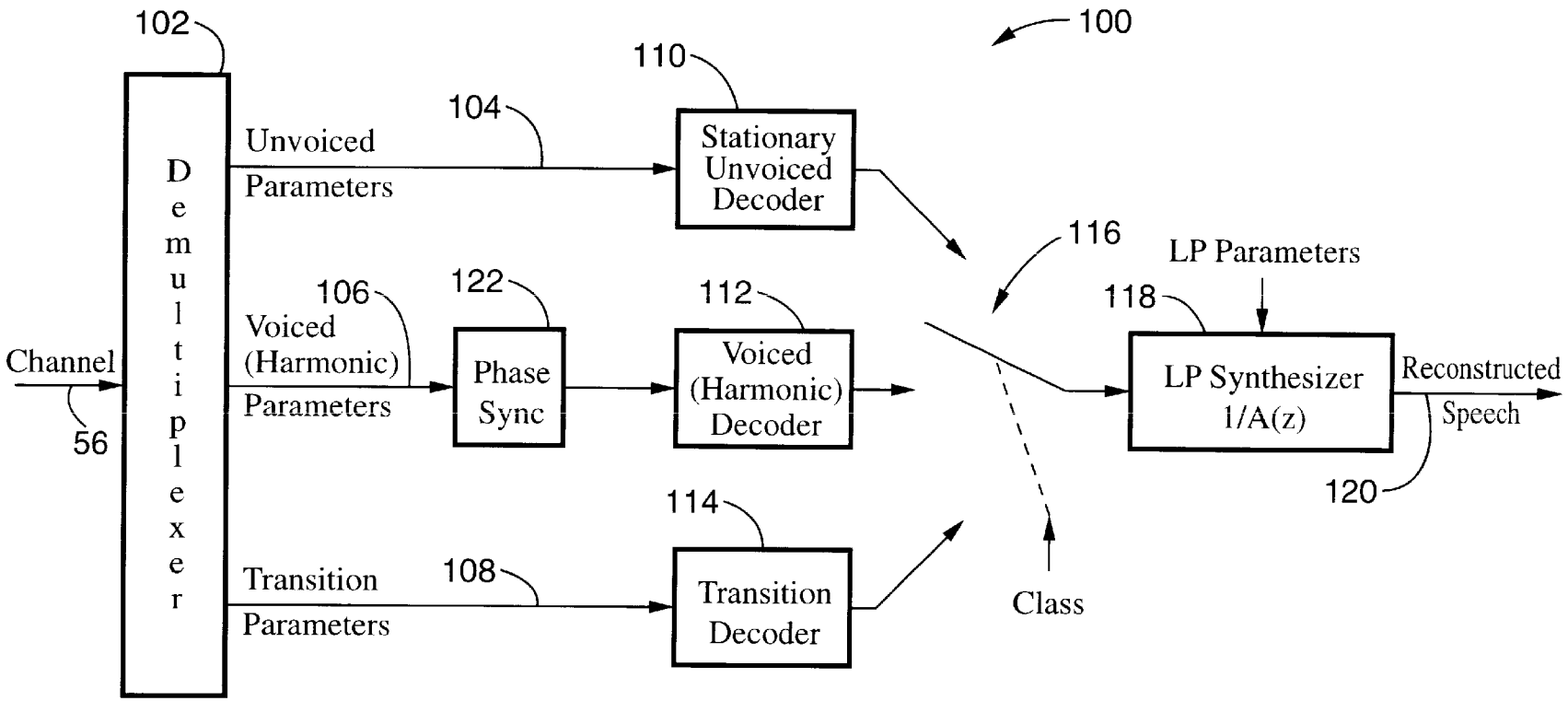
FIG. 5 is a functional block diagram of a hybrid decoder in accordance with the present invention.

Referring also to FIG. 5, a hybrid decoder 100 in accordance with the invention is shown. Decoder 100 includes a demultiplexer 102 that separates the multiplexed encoded speech received over data channel 56. The stationary unvoiced 104, voiced 106, and transition 108 speech signals are decoded by a stationary unvoiced decoder 110, a voiced decoder 112, or a transition decoder 114, respectively, according to classification data sent with the frames from the encoder that controls switch 116. A conventional LP synthesizer 118 then produces reconstructed speech 20 using the previous LP parameters from the encoder. Note that the decoder also includes a phase synchronization module 122.

2. Model Switching and Phase Synchronization

Since no phase information is sent from the encoder to the decoder, phase synchronization is based solely on the reconstructed speech (at the decoder) and the reconstructed speech and the original speech (at the encoder). Phase synchronization when switching from the transition model to the voiced (harmonic) model (onset synchronization) is performed in both the decoder and encoder. The decoder uses the estimated linear phase for the reconstruction of the speech, and the encoder uses the linear phase to keep track of the phase evolution which is needed for the next synchronization step to occur later when switching from the voiced model to the transition model (offset synchronization).

If the initial linear phase of the harmonic model for a periodic speech segment is chosen arbitrarily, the harmonically synthesized speech is not aligned with the target signal. On the other hand, the time-domain coding module for the transition frames is designed to capture the local time events characteristics of the target signal and hence its output is time-aligned with the target signal. As a result, when switching from the frequency domain harmonic model to the time domain transition model, signal discontinuity may occur at the frame boundaries.

Figure 6A:
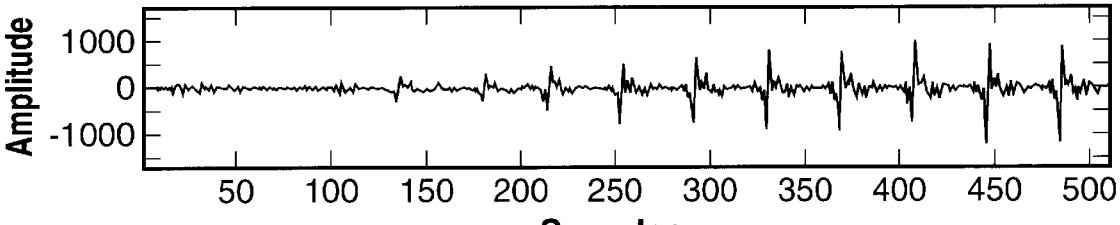
FIG. 6A through FIG. 6C show examples of waveforms that demonstrate onset synchronization.
Figure 6B:
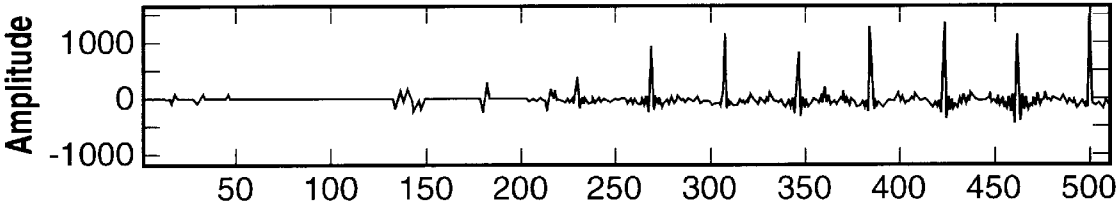

2.1 Synchronization when Switching from a Transition Segment to a Harmonic Segment A transition segment may be followed by a harmonic segment, for example, at a vowel onset, where a sequence of glottal pulses buildup is followed by a periodic voiced signal. The initial linear phase of the harmonic segment, $\theta_0$, is required to provide signal continuity but additional bits would be needed for its transmission. FIG. 6A depicts the original residual of an onset segment. This segment consists of six 10 ms frames, where the first three were classified as transition frames and the last three were classified as harmonic frames. The transition frames were coded using multi-pulse excitation, and the harmonic model was used for the harmonic frames. FIG. 6B shows the reconstructed excitation without synchronization, when the initial linear phase was simply set to zero. Note the signal discontinuity and the pulse doubling at the section where the frames were overlapped-and-added between the 200 and the 250 samples.

To solve the misalignment problem and to provide signal continuity during onset switching, the initial linear phase has to be estimated and used in the synthetic phase model. A reconstructed test harmonic frame, using $\theta_0=0$, is first synthesized. The test harmonic frame is slid over the preceding transition frame in order to find $l_{max}$, the lag which maximizes the normalized correlation between the overlapped portions of the two signals. The normalized correlation for time shift j is given by the formula:

$$c_j = \frac{\sum_n \hat{e}(n)\hat{e}_p(n+j)}{\sum_n [\hat{e}(n)]^2} \tag{11}$$

where $\hat{e}(n)$ is the synthesized residual with zero phase, $\hat{e}_p(n)$ is the previous frame's synthesized residual, and the range of each summation is chosen to correspond to the subframe length.

Figure 6C:
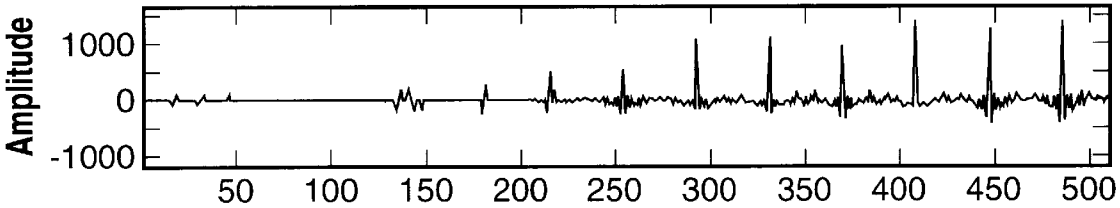

The initial linear phase is given by:

$$\theta_0 = \frac{2\pi f_p l_{\max}}{F_s}, \tag{12}$$

where $f_p$ is the pitch frequency of the harmonic frame, and $F_s$ is the sampling frequency. FIG. 6C demonstrates the result of linear phase estimation, and shows that signal continuity is achieved by frame synchronization. It is important to observe that the initial phase estimate is required to provide signal continuity during switching from transition frame to harmonic frame, but complete phase synchronization between the target signal and the reconstructed signal is not required for achieving the desired speech quality. For example, a reconstructed voiced segment which comes after a stationary unvoiced segment will use $\theta_0=0$ but would suffer no quality degradation, despite its misalignment with its target signal.

The onset synchronization is performed at the speech decoder and does not require transmitting additional phase information. The correlation maximization is performed between the previously reconstructed transition frame and a test harmonic frame generated from the coded harmonic parameters. Note that the encoder must also carry out the onset linear phase estimation procedure and to keep track of the reconstructed phase in order to be able to perform the offset phase synchronization, described in the following section.

Figure 7A:
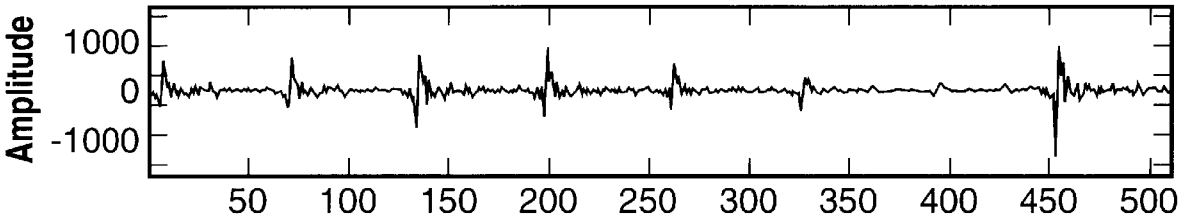
FIG. 7A through FIG. 7C show examples waveforms that demonstrate offset synchronization.
Figure 7B:
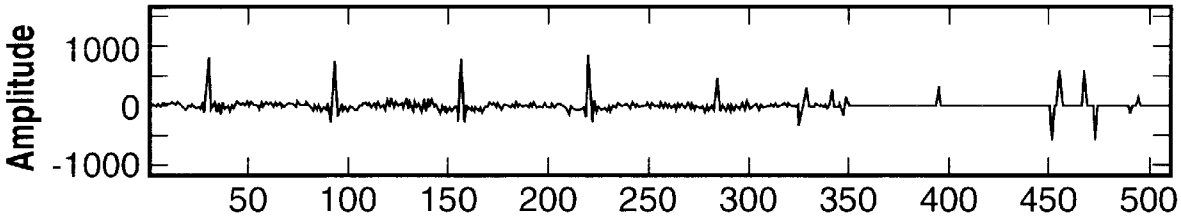

2.2 Synchronization when Switching from a Harmonic Segment to a Transition Segment A transition segment can follow the end of a harmonic segment (offset) if the glottal activity is still strong but the periodicity is distorted. A transition segment can also come after a harmonic segment during a vowel-consonant-vowel sequence. Despite the onset synchronization described in section 2.1 above, a linear phase deviation can occur between the synthesized harmonic signal and the original signal. Several factors contribute to this misalignment. First, it is possible that the onset synchronization, while maximizing signal continuity at the frames boundary by aligning the overlapped sections of both frames, does not provide an exact alignment between the original and the reconstructed harmonic signal in the frames that follow the first frame of a harmonic segment. Second, pitch estimation and quantization errors, as well as the approximate character and the discrete nature of the phase evolution formula, further contribute to the deviation of the linear phase. Linear phase deviation means that the synthesized harmonic frame is not synchronized with the original harmonic frame. Since the transition frame which comes after the last frame of the harmonic segment is time aligned with the original frame, signal continuity might be lost at the frame boundary. FIG. 7A depicts the original residual where a harmonic segment is followed by a transition segment. FIG. 7B shows the reconstructed excitation where the harmonic model was used for the harmonic segment and the multi-pulse structure, without synchronization, was used for the transition segment. Note the pulse doubling on the switching interval between the 300 and the 350 samples.

Figure 7C:
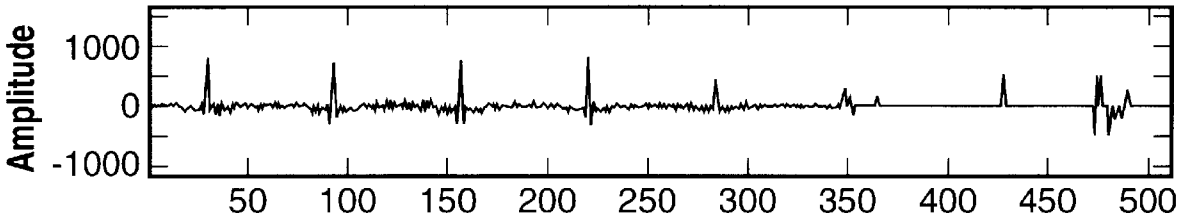

The offset phase synchronization module provides signal continuity when switching from harmonic frame to transition frame. The encoder estimates the misalignment between the original signal and the coded harmonic signal by shifting the reconstructed harmonic signal over the original one and finding the shift lag which maximizes the normalized correlation between the two signals. The normalized correlation for time lag i is given by the formula:

$$c_i = \frac{\sum_n \hat{e}_p(n)e(n+i)}{\sum_n [e(n+i)]^2} \tag{13}$$

where the range of each summation is chosen to correspond to the subframe length. The encoder then applies the same shift to the analysis of the transition frame. Since the decoder reconstructs the last harmonic frame and the following transition frame using the same shift, signal continuity is preserved at the frame boundary. FIG. 7C demonstrates the result of the offset synchronization scheme which provides signal continuity when switching from the harmonic model to the transition model, as demonstrated by the coincidence of the pulses on the switching interval between the 300 and the 350 samples. Note also the change in the location and magnitude of the pulses used to represent the transition segment, due to the shift in the analysis frame and the coding restriction on the pulse locations.

2.3 Phase Continuity and Reset

The initial linear phase (which is estimated when switching from a transition segment to a harmonic segment) propagates from the first frame of the harmonic segment to the following frames by the phase evolution described in Eq. (4) or Eq. (6).

Similarly, the hybrid encoder should apply the same phase shift, estimated when switching from a harmonic frame to a transition frame, to all the consecutive frames of the transition segment.

Since the phase information is not used for the synthesis of stationary unvoiced segments, no phase synchronization is required when switching to or from such segments. Moreover, any phase correction term can be reset when a stationary unvoiced segment is encountered.

Figure 8:
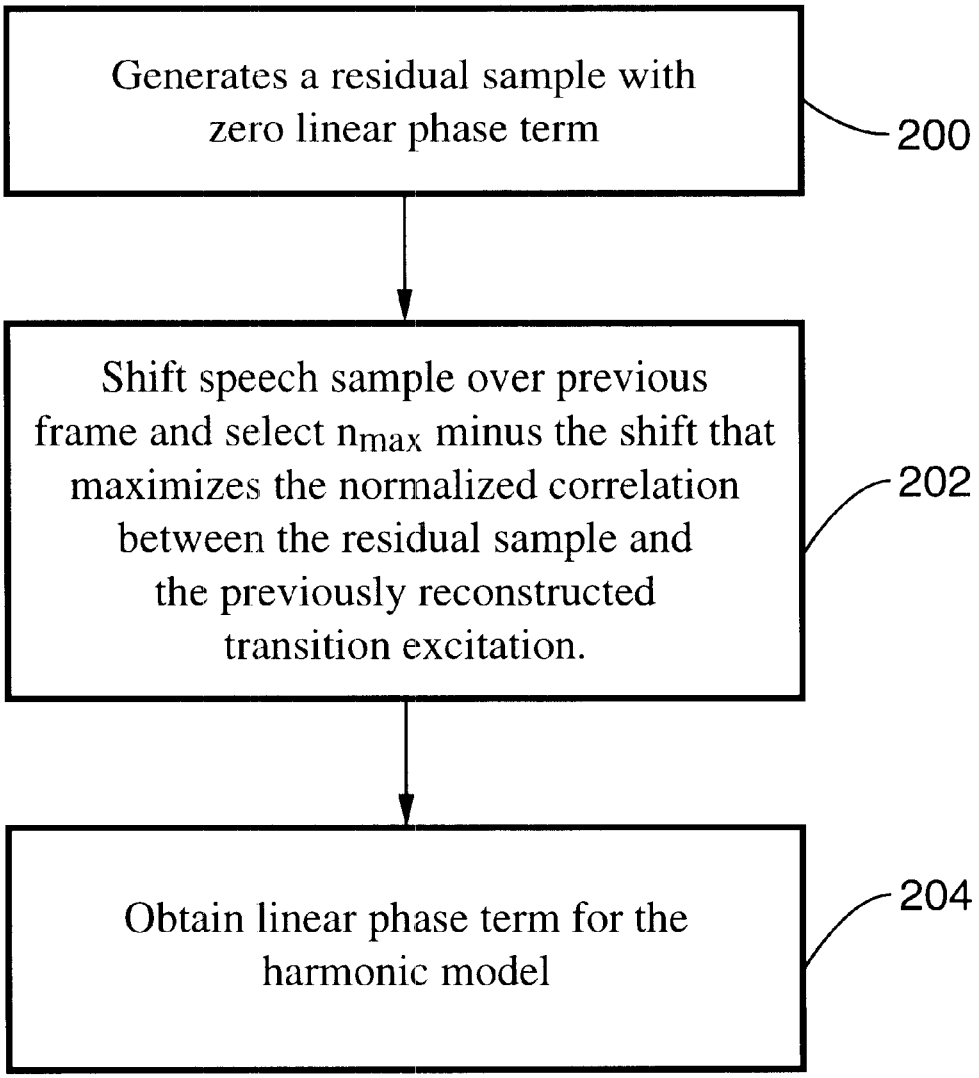
FIG. 8 is a flow chart showing phase synchronization for switching from a transition frame to a voiced frame in accordance with the invention.
Figure 9:
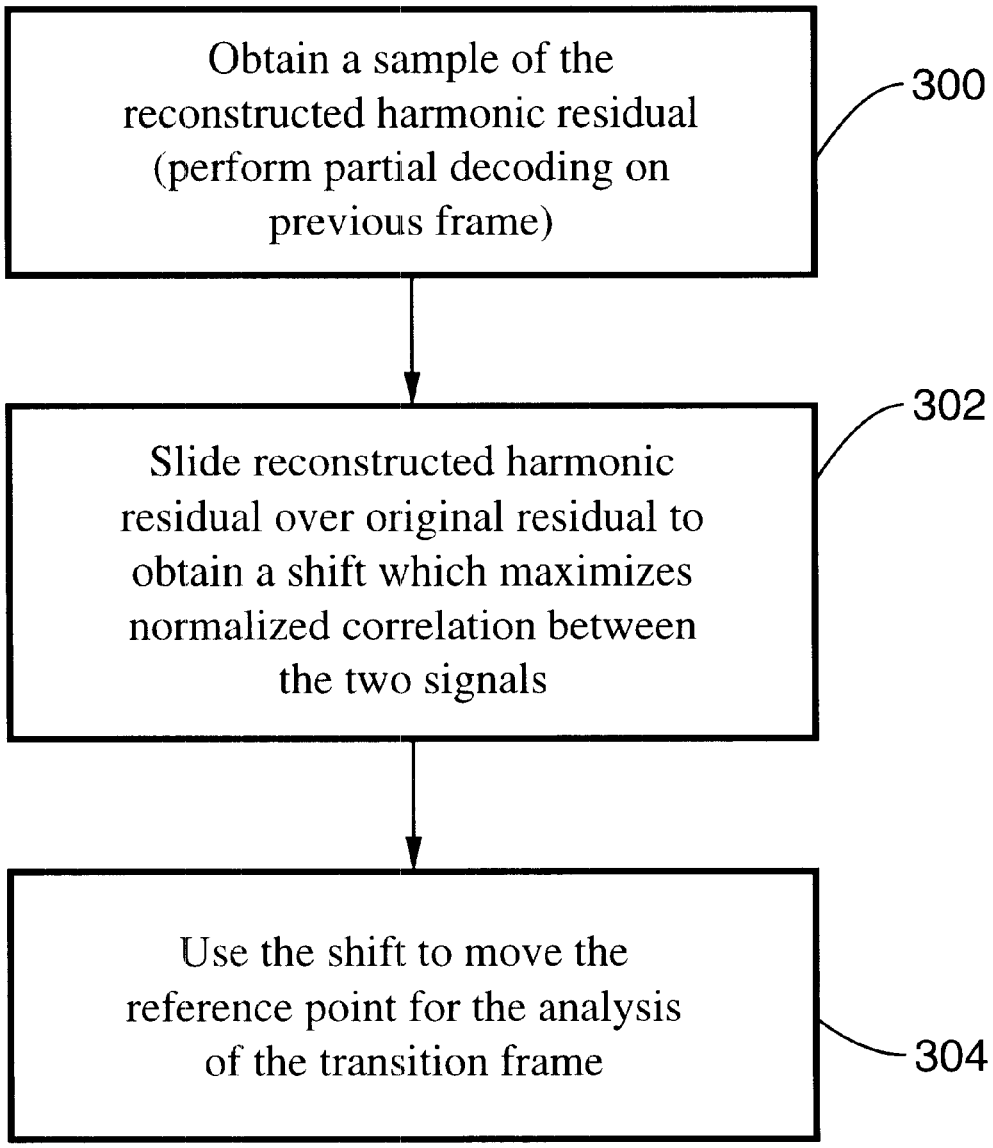
FIG. 9 is a flow chart showing phase synchronization for switching from a voiced frame to a transition frame in accordance with the invention.

The foregoing can be summarized by referring to FIG. 8 and FIG. 9. Onset phase synchronization is performed according to the steps summarized in the flow chart of FIG. 8. Phase synchronization during offset is carried out at the encoder according to the steps summarized in the flow chart of FIG. 9. Referring first to FIG. 8, at step 200, a residual sample with zero linear phase term is generated. Next, at step 202, the speech sample is shifted over the previous frame and we select $n_{max}$ minus the shift that maximizes the normalized correlation between the residual sample and the previously reconstructed transition excitation. Finally, at step 204, the linear phase term for the harmonic model is obtained using Eq. (12). Referring now to FIG. 9, at step 300, a sample of the reconstructed harmonic residual is obtained by performing partial decoding on the previous frame. Next, at step 302, we slide the reconstructed harmonic residual over the original residual to obtain a shift which maximizes the normalized correlation between the two signals. Finally, at step 304, we use the shift to move the reference point for the analysis of the transition frame.

3. Hybrid Coder Design Parameters

We have designed a 4 kbps hybrid coder employing three distinct speech models and phase synchronization as described above. The 4 kbps hybrid coder required the design of a new classifier, a spectral harmonic coding scheme and a specially designed multi-pulse scheme to capture the location and structure of the time events of transition frames. We conducted subjective listening tests which indicated that hybrid coding can compete favorably with CELP coding techniques at the rate of 4 kbps and below.

The rate of 4 kbps was chosen to demonstrate the hybrid coding ability at the bit rates between 2 kbps, where harmonic coders can produce highly intelligible communication quality speech, and 6 kbps, where CELP coders deliver near toll-quality speech. The following sections describe the details of the 4 kbps coder and also address some important issues in harmonic and hybrid coding, such as classification and variable dimension vector quantization for spectral magnitudes.

3.1 Linear Prediction Analysis and Quantization

The 4 kbps coder operates on telephone bandwidth speech, sampled at the rate of 8 kHz. The frame size is 20 ms and the lookahead is 25 ms. The DC component and the low-frequency rumble are removed by an 8th-order IIR high-pass filter with a cutoff frequency of 50 Hz.

The LP analysis, performed one frame ahead of the coding frame, is very similar to the one suggested for the ITU-T Recommendation G.729 [26]. It utilizes a nonsymmetric window with a 5 ms lookahead, and bandwidth expansion and high frequency compensation performed on the autocorrelation function. The autocorrelation is calculated from the windowed speech, and bandwidth expansion and high frequency compensation is performed. The 10th order LP coefficients are calculated using the Levinson-Durbin algorithm, converted to the LSF representation and quantized by an 18 bit predictive two-stage quantizer using 9 bits for each stage. The optimal design of the predictive LSF quantizer follows LeBlanc et al [27] and Shlomot [28]. The LSFs are quantized using 18 bits in a predictive two-stage VQ structure and employing a weighted distortion measure. The quantization weighted error measure is similar to the weighted error measure proposed by Paliwal and Atal [29]. The quantized LSFs are interpolated each 5 ms and converted back to prediction coefficients which are used by the inverse LP filter to generate the residual signal.

Classification, pitch frequency, and harmonic bandwidth are obtained every subframe. A class decision for each frame is derived from the subframe decisions. Then the appropriate coding scheme for the class, harmonic, unvoiced, or transition, is performed on each frame.

3.2 The Classifier, Pitch Detector and Harmonic Bandwidth Estimator

Effective classification, pitch detection, and harmonic bandwidth estimation (voicing) are essential for the hybrid codec of the present invention. We address these topics in the same framework, since the "classifier" module 18 in FIG. 4A serves also as pitch detector and harmonic bandwidth estimator (voicing). An initial pitch estimate is obtained as part of the classification process, and if the frame is declared a harmonic frame, a combined procedure estimates the harmonic bandwidth and a refined pitch frequency. Most harmonic coding schemes, as well as some types of CELP coding schemes [30][31], employ speech classifiers which assist the coding algorithm. However, the three-mode classification task for our hybrid coder is different from these conventional classifiers and requires a new classifier.

We use a set of parameters as input features for the classification which comprises the speech energy, speech zero-crossing rate, a spectral tilt measure, a residual peakiness measure, three parameters which measure the harmonic structure of the spectrum, and a pitch deviation measure. The first four parameters are well-known in the art and have been used in the past for voiced/unvoiced classification of speech segments. The measure of harmonic structure of the spectrum was also used before [3] but we used three measures, which test the harmonic matching for each of the two, four and six lower frequency harmonics, to provide spectral harmonic matching even at voiced offsets. The harmonic matching measures are calculated using three combs of synthetic harmonic structures which are gradually opened while guided by a staircase envelope of the spectrum and compared to the spectral magnitude of the residual. The signal-to-noise ratio (SNR) at the opening frequency which maximizes the SNR is taken as the harmonic matching measure, and the pitch deviation measure is obtained from the difference of this initial pitch estimate from one frame to the next.

Classifier design requires parameters selection and the choice of discriminant function. We chose a large set of parameters which were shown to be important for speech classification in various applications. We avoided the difficulties in the design of the discriminant function by employing a neural network classifier trained from a large training set of examples.

The classification parameters from the previous, current, and the next frame are fed into a feed-forward neural network, which was trained from a large database of classification examples. The output of the net from the previous frame is also fed into the net to assist in the decision of the current frame. The output of the neural network consists of three neurons, and the neuron with the highest level indicates the class. Hysteresis was added to the decision process to avoid classification "jitter". Hysteresis is included by adjusting the classifier so that the class assignment for the current frame favors the class that was assigned to the prior frame. Standard methods are available for the design of such neural networks from training data. We generated training data by manually determining the class by visual inspection of the speech waveform and spectrum and labeling speech files for use as training data.

For a frame that was declared "voiced" by the classifier, a frequency-domain harmonic-matching algorithm is used for pitch refinement and to determine the harmonic bandwidth. The pitch and the harmonic bandwidth are quantized, and all three parameters—class, pitch and harmonic bandwidth—are sent to the decoder. At the decoder, some or all of these parameters are smoothed over time, to avoid rapid changes that can generate audible artifacts.

3.3 Classification Parameters

For each subframe we obtain the signal energy, spectral tilt, rate of zero-crossing, residual peakiness, harmonic matching SNRs and pitch deviation measures. Similar harmonic matching measures were used as part of the voiced/unvoiced classification in other harmonic coding schemes [6][8]. Energy, spectral tilt and zero-crossing rate were shown to be important for speech activity detection [32], and the peakiness measure was suggested as an important classification parameter for the detection of aperiodic pulse structure [11]. A vector of classification parameters is formed for each subframe by the concatenation of three sets of parameters, representing the signal for the past, current and future subframes.

For the harmonic matching measures and the initial pitch estimation we use a frequency domain harmonic comb which is generated by harmonic repetition of the main lobe of a window function, where the harmonic amplitudes are determined by the estimated spectral envelope [6]. We use a comb of six "teeth" and obtained the signal-to-noise ratios between the residual spectrum and the synthetic model for two, four, and six "teeth" as the comb was opened from 60 Hz to 400 Hz. The frequency which maximizes the sum of the three SNRs is chosen as the initial pitch estimate.

The initial pitch estimate is obtained as the harmonic comb is opened from 60 Hz to 400 Hz, and the center of last "tooth" covers the range from 360 Hz to 2400 Hz. As in other pitch detection algorithms, only low frequency components of the signal are considered for pitch detection. However, in our approach, the portion of the examined spectrum depends on the pitch, which results in very robust pitch estimation even without a pitch tracking algorithm.

3.4 Neural Network Classification

The codec employs a neural network based discriminant function trained from a large training set of examples. The classification parameters are fed into a three layer feed-forward neural network. The input layer has the dimension of the classification parameter vector, the hidden layer has 48 neurons and the output layer has three neurons, one for each class. A nonlinear sigmoid function is applied at the output of each neuron at the hidden and output layer. The network is fully connected, and the network decision from the previous frame is fed back into it as an additional parameter. A large database (~15,000 frames) was manually classified to provide the supervised learning means for the neural network. The network connecting weights were trained using the stochastic gradient approach of the back propagation algorithm [33]. The "winning" output from the three output neurons specifies the class, but some heuristically tuned hysteresis was added to avoid classification "jitter".

3.5 Quantization of the Classification Parameters

Only one bit is needed for specifying the class of each subframe by differentiating between a transition subframe and another type of frame. The harmonic bandwidth serves as a gradual classification between harmonic speech and stationary unvoiced speech, and the value of zero harmonic bandwidth indicates a subframe of stationary unvoiced speech.

Some harmonic coders use a complicated harmonic vs. non-harmonic structure, which require a large number of bits for transmission [7]. In our 4 kbps framework, the harmonic bandwidth serves as a practical and simple description of the spectral structure, and is quantized with only 3 bits. To compensate for errors in the harmonic bandwidth estimation, which can have large fluctuations from one frame to the next and create audible artifacts, the decoder employs a first order integrator on the quantized harmonic bandwidth with an integration coefficient of 0.5.

3.6 Pitch Frequency Quantization

The exact value of the pitch period, down to sub-sample precision, is crucial for CELP type coders which employ the pitch value to achieve the best match of past excitation to the current one using an adaptive codebook. The role of the pitch frequency is different for harmonic coding and should be carefully examined. At the encoder, the pitch frequency is used for the analysis and sampling of the harmonic spectrum. At the decoder, the pitch frequency is employed to derive the phase model which is used by the harmonic oscillators. While exact pitch frequency is needed for the harmonic analysis at the encoder, only an approximate pitch frequency is needed for the decoder harmonic oscillators, as long as phase continuity is preserved. For our 4 kbps coder, the pitch frequency is uniformly quantized in the range of 60 Hz to 400 Hz using a 7 bit quantizer. Some preliminary tests and other work [34] suggest that the number of bits used for pitch representation can be further reduced.

3.7 Pitch Refinement and Harmonic Bandwidth Estimation

Pitch refinement and harmonic bandwidth estimation can be combined into one procedure, which also uses harmonic matching between a comb of harmonically related main lobes of the window function and the residual spectral magnitude. The SNR as a function of the number of comb elements (and hence the frequency) is calculated, starting from a comb of four elements and gradually increasing the number of elements. As the size of the comb increases, the pitch frequency is refined. For mixed voiced and unvoiced speech, the upper portion of the spectrum is non-harmonic, and the SNR decreases as the number of comb elements is increased. The harmonic bandwidth is determined by a threshold on the SNR as a function of the frequency. The final pitch is given by the refined pitch at the upper limit of the harmonic bandwidth.

3.8 Robust Pitch Estimation Using Signal Modification

Signal modification is a signal processing technique whereby the time scale of a signal is modified so that the signal will more accurately match a reference signal called the target signal. The time scale modification is done according to a continuous modification function applied to the time variable. This function is sometimes called a warping function, and the modification operation is also called time-warping. If properly selected constraints are applied to the warping function and if a suitably generated target signal is obtained, the linear prediction (LP) residual signal (obtained from the original speech by inverse filtering) can be modified without affecting the quality of the resulting speech that is reproduced by synthesis filtering of the modified LP residual. For brevity we shall call the LP residual simply as the 'residual'.

Signal modification has been previously used in analysis-by-synthesis speech coding [40][41]. We have discovered a novel and general paradigm for robustly estimating parameters in a harmonic speech coding system based on signal modification. We first describe the general concept and then specialize it to the case of pitch estimation, which we have successful tested in our simulation of hybrid coding.

3.8.1 General Approach To Parameter Estimation.

Figure 10:
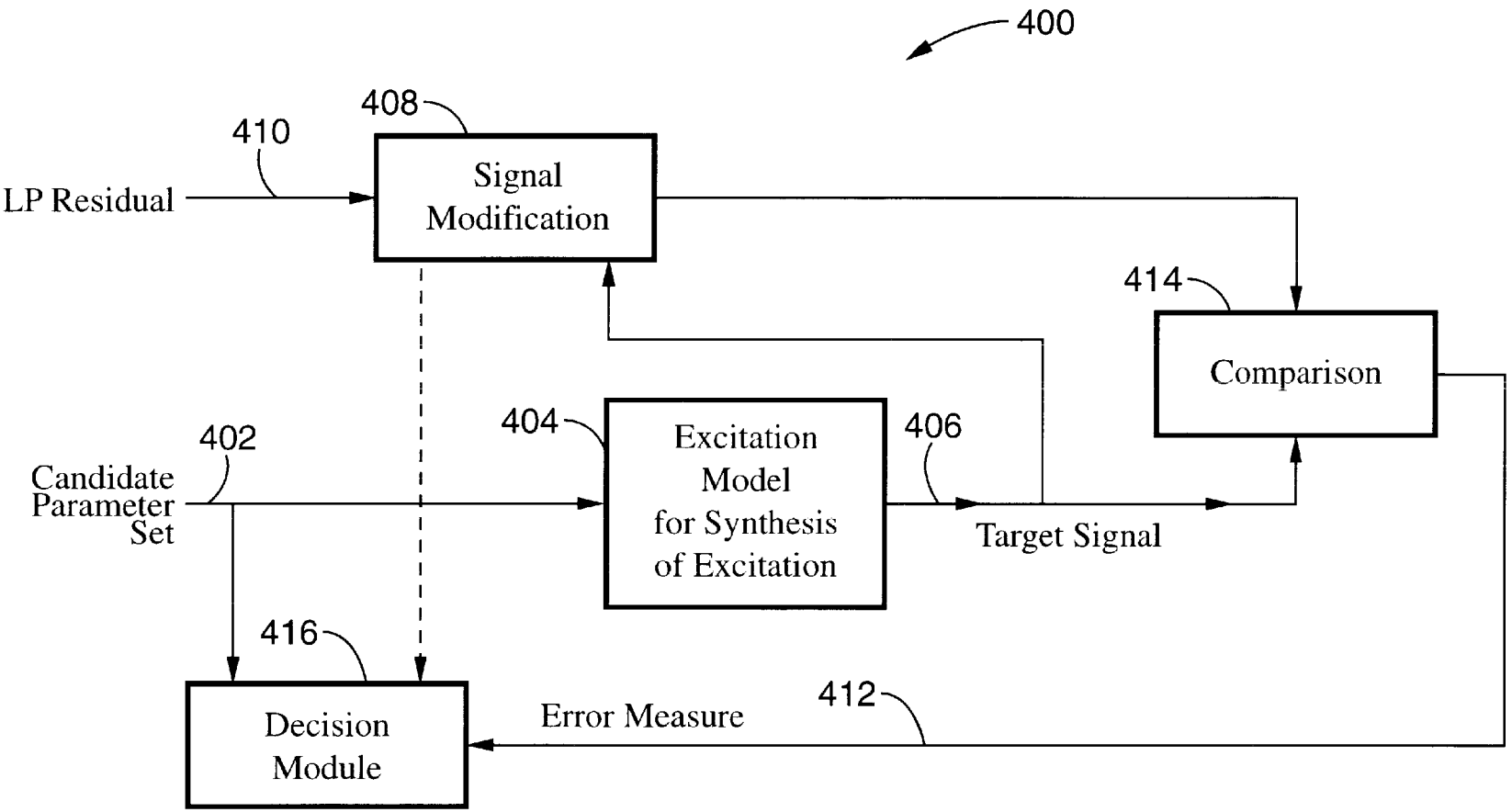
FIG. 10 is a diagram showing robust parameter estimation by signal modification in accordance with the invention.

Our approach is based on the fact that for an effective estimate of model parameters, the residual after it has undergone a suitably chosen signal modification should match the synthetic excitation. A reasonable criterion for example, is to minimize mean-squared error (MSE) between the modified residual and the synthetic excitation; however other factors also need to be considered in the final selection of the model parameters. FIG. 10 shows the block diagram of this general procedure 400. A candidate parameter set 402 is applied to an excitation synthesis model 404 and a synthetic excitation signal is produced. This excitation is the target signal 406. The signal modification module 408 performs a warping of the LP residual 410 so that it will best match the target signal under constraints that ensure that the modified residual signal will yield speech quality as good as the original one. For each of several candidate parameter sets, the modification is performed and an error measure 412 is computed by a comparison module 414. The error measure and possibly other extracted signal features are applied to a decision module 416 that makes a final choice of the best parameter set. The synthesized speech can then be obtained by synthesis filtering of the synthetic excitation that was generated from the final parameter set.

3.8.2 Pitch estimation with signal modification.

Now we specialize the parameter estimation method (as tested in our current embodiment) where the pitch value for a speech frame is the needed parameter and a number, M, of pitch candidates are selected as candidates for the modification procedure. These candidates are obtained from the pitch estimator, which in our case is the frequency-domain matching similar to that described in [6] but operating on the LP residual, by choosing the fundamental frequencies which produce the M largest SNRs. The SNR values obtained from the pitch estimator are used as "weights" associated with the different pitch candidates and indicating the relative importance of each candidate. Modified weight values, computed using the MSE values from the signal modification module, are used as a contributing factor in the selection of the final pitch value. One of these candidates will be selected as the final pitch value by a speech smoother module, which is the specific form of the general "decision module" of the previous paragraph. The pitch smoother uses information from the signal modification module as well as the MSE in the decision procedure. This method of pitch estimation can be applied to any time-domain or frequency domain pitch estimation technique used in a hybrid or in a harmonic coder.

Figure 11:
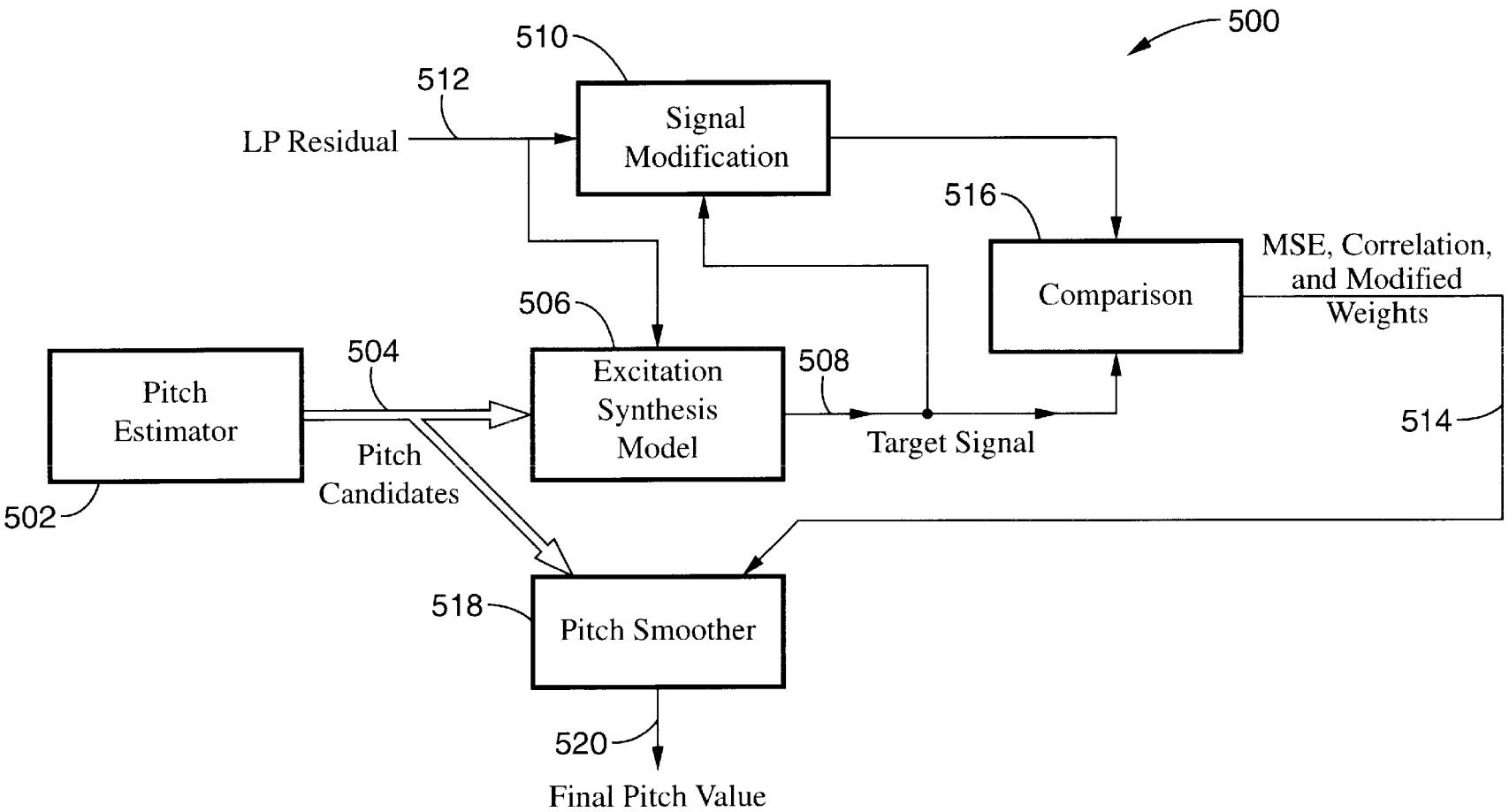
FIG. 11 is a diagram showing robust pitch estimation by signal modification in accordance with the invention.

FIG. 11 shows a general block diagram of the pitch estimation method 500. A pitch estimator module 502 produces a plurality of pitch candidates 504. The pitch candidate set 504 and LP residual 512 are applied to an excitation synthesis model 506 and a synthetic excitation signal is produced. This excitation is the target signal 508. The signal modification module 510 performs a time warping of the LP residual 512 so that it will best match the target signal under constraints that ensure that the modified residual signal will yield speech quality as good as the original one. Time warping of a signal to match another reference signal is a well known procedure [42]. For each of several pitch candidate parameter sets, the modification is performed and an MSE, normalized correlation, and modified weights 514 are computed by a comparison module 516. The MSE, normalized correlation and the modified weights are applied to a pitch smoother module 518 to produce a final pitch value 520.

Figure 12:
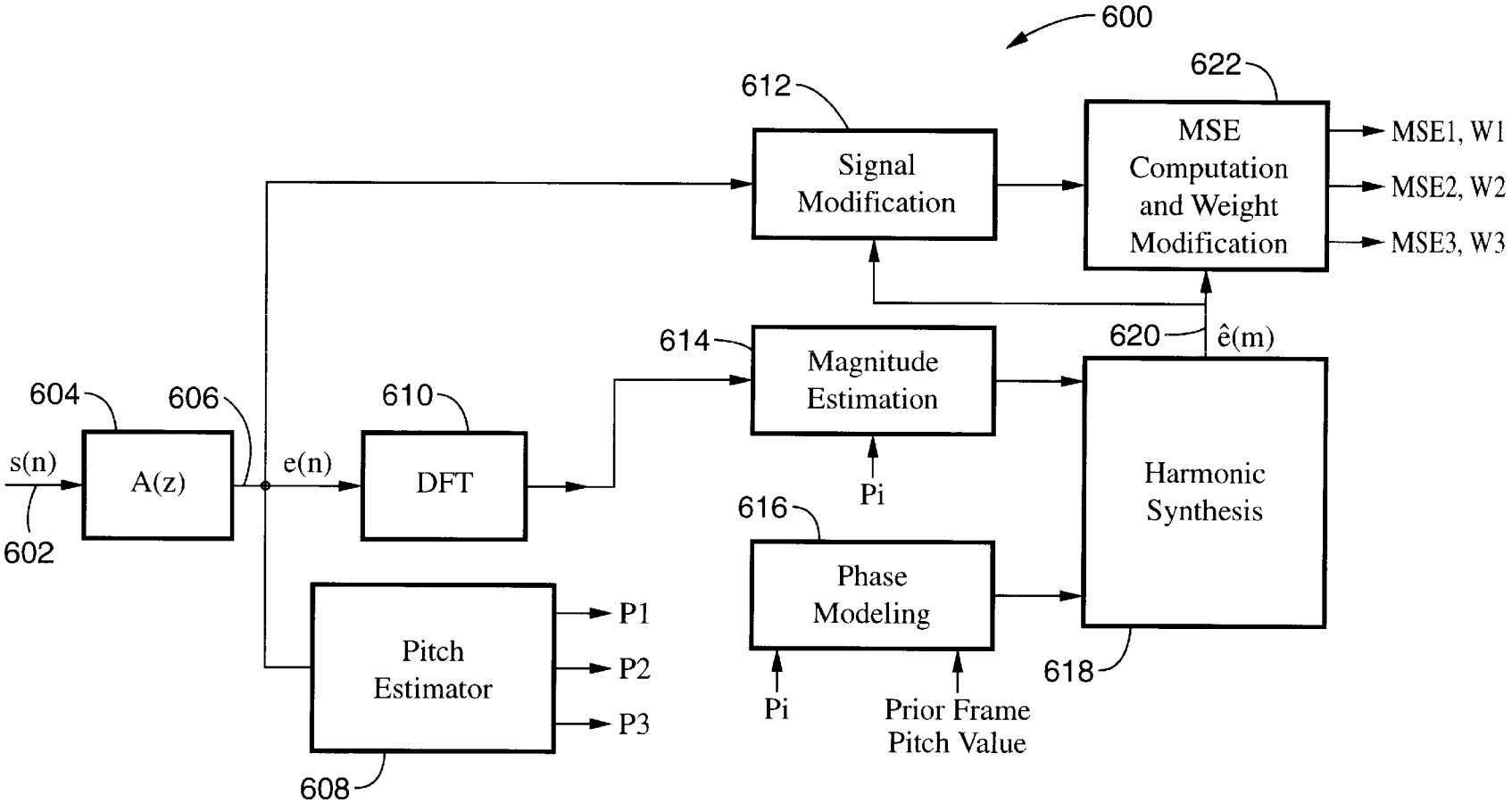
FIG. 12 is a diagram showing details of excitation modeling for robust pitch estimation by signal modification in accordance with the invention.

A more detailed block diagram 600 showing the excitation modeling is given in FIG. 12. The speech signal 602 is applied to an inverse LP filter 604 to produce an LP residual signal 606. The LP residual is applied to a pitch estimator 608 which produces a plurality of pitch candidates P1, P2, P3. The LP residual is also applied to a DFT module 610, and a signal modification module 612. The output of the DFT module 610 is applied to the input of a magnitude estimator 614, wherein estimation of the spectral magnitudes is performed for each pitch candidate Pi. Phase modeler 616 models the spectral phase is performed for each pitch candidate Pi using the prior frame pitch value. The resultant estimates are applied to harmonic synthesis module 618, where a synthesized residual, $\hat{e}(n)$, is produced for use as the target signal 620 for signal modification. The MSE computation and weight modification module 622 then computes the MSE between the modified LP residual from signal modification module 612 and the synthetic residual $\hat{e}(n)$ based on each pitch candidate, as well as computes the modified weights W1, W2, W3.

More specifically, the method comprises a number of steps as follows. First, for each pitch candidate, a target signal is synthesized with the harmonic model. Specifically, to generate the target signal, the spectral amplitudes are obtained by sampling the residual speech spectrum at the harmonics of the pitch candidate, and the spectral phases are derived from the previous frame's pitch and the current pitch candidate, assuming a linear pitch contour. Second, the residual signal modification is performed by properly shifting each pulse in the original speech residual to match the target signal under constraints which ensure that the modified residual signal will give speech quality as good as the original one. The constraints are the same form as is usually done in time warping [42][43]. Specifically, in our case the constraints are (a) the adjustment to the accumulated shift parameter for each time segment containing one significant pulse is constrained to lie within a range bounded by three samples, and (b) the adjustment to the accumulated shift parameter is zero if a threshold of 0.5 is not exceeded by the normalized correlation computed for the optimal time lag. If the pitch candidate is not correct, the modified signal will not match the target signal well. The alignment between the target signal and the modified signal will be very good when a pitch candidate results in a well-fitted pitch contour. To assess the quality of matching, we use both the correlation and the MSE between the target signal and the modified signal. Finally, the weights of each pitch candidate are changed by increasing the weight of a candidate which gives high correlation and low MSE and reducing the weight of a pitch candidate which gives relatively low correlation and high MSE. For the pitch candidate with minimum MSE, the corresponding weight value is modified by increasing its value by 20%. For the pitch candidate with maximum normalized correlation, its value is modified by increasing it by 10%. All other weights are left unchanged. Pitch candidates that result in poor matching are eliminated and the pitch candidate that has the largest weight after modification is selected.

3.9 Spectral Envelope Analysis and Quantization

For harmonic subframes and stationary unvoiced subframes, a spectral representation of the residual signal is obtained using a Hamming window of length 20 ms, centered at the middle of the subframe, and a 512 point DFT. The harmonic samples at the multiples of the pitch frequency within the harmonic bandwidth are taken as the maximum of the three closest DFT bins. At the frequencies above the harmonic bandwidth the spectrum is represented by an average of the DFT bins around the multiples of the pitch frequency. For stationary unvoiced frames we use the value of 100 Hz for the frequency sampling interval, as suggested by McAulay and Quatieri [6].

The sampling (or averaging) procedure generates a variable dimension vector of the sampled harmonic spectral envelope. The vector dimension, M, is inversely proportional to the pitch frequency $f_p$ and is given by $$M = \left\lfloor \frac{F_s}{2f_p} \right\rfloor, \tag{14}$$

where $F_s$ is the sampling frequency, which is 8 kHz for a telephone bandwidth signal. If we assume that the range of human pitch frequency is between 60 Hz to 400 Hz, the dimension of the spectral samples vector varies from 67 to 10 samples.

The efficient quantization of the variable dimension vector of spectral samples, which is a crucial issue in mixed signal coding, was addressed by a number of contributions [35][6][15][36]. It should be noted that the pitch frequency, which determines the vector dimension M, is known to the decoder, and therefore all harmonic coders use a pitch dependent quantization scheme.

Vector quantization is a powerful tool in signal compression and most harmonic coders use VQ to describe the harmonic spectral envelope. Direct application of VQ to the variable dimension vector of spectral samples is achievable, if a special codebook is designed for each possible dimension M. However, this "optimal" solution is quite impractical and results in prohibitive requirements for both the memory storage for the codebooks and the size of the training set needed for their design. The prevailing approach for variable dimension vector quantization is to convert the variable dimension vector into a fixed dimension vector and then quantize it. The decoder extracts the quantized fixed dimension vector and, assisted by the quantized pitch value, converts it into the quantized variable dimension vector.

The various methods for dimension conversion can be grouped into two classes: linear or nonlinear. By linearity we mean that the fixed dimension vector is a linear (pitch dependent) function of the variable dimension vector. The nonlinear methods include, for example, the LPC [6] and the DAP [12] methods. Examples of linear methods are the bandlimited interpolation [13], the VDVQ [14] and the zero-padding method [37]. The general form of linear dimension conversion scheme was presented in [15] under the name Non-Square Transform (NST).

We tested the nonlinear method of DAP and the linear method of bandlimited interpolation at early stages of this work, but with unsatisfactory results. The DAP method suffers from large modeling error, in particular for the case of small number of harmonics typical of female speech. Bandlimited interpolation suffers from an additional aliasing error which results from the quantization of the higher dimension vector and the conversion to lower dimension. This aliasing error can be avoided by a pitch dependent dimension conversion filter, but would require higher complexity.

Let us focus on the linear schemes, and specifically on the general form of NST. In NST, a fixed dimension vector y is generated from the variable dimension vector x by multiplying x with a non-square matrix B of dimension N×M. It is important to remember that B is one of a family of matrices, since its dimension depends on M, which in turn depends on the pitch frequency. The invertibility of B for the two distinct cases of $M \leqq N$ and $N<M$ was discussed in [15], where it was shown that x (or an approximated version of it) can be recovered by $x=Ay$, where $A=B^T(BB^T)^{-1}$ for the case $M \leqq N$ and $A=(B^TB)^{-1}B^T$ for the case $N<M$.

We address here the issue of Weighted Mean Square Error (WMSE) minimization using the NST. In order to minimize the spectral quantization error in the speech domain the spectral samples of the residual should be multiplied by the magnitude of the LP synthesis filter. Perceptually weighted error minimization in the spectral domain can also be applied, as was suggested in [22]. The combined contribution of the spectral magnitude of the LP synthesis filter and the perceptual weighting measure is applied to the distance between each component of the original (variable dimension) spectral vector x and of the quantized spectral vector $x_q$. The WMSE, $\in$, is given by $$\in=(x-x_q)^T W(x-x_q), \tag{15}$$

Since the quantization is performed on the fixed dimension vector y, and since $x=Ay$, Eq. (13) takes the form of $$\in=(A_y-A_{y_q})^T W(A_y-A_{y_q})=(y-y_q)^T A^T W A(y-y_q). \tag{16}$$

Special care should be taken, from practical computation considerations, in choosing the transform matrices pair A and B such that $A^TWA$ is a diagonal matrix. It can be shown that $A^TWA$ is diagonal for the VDVQ and the zero padding methods, and that for the bandlimited interpolation $A^TWA$ can be approximated by a diagonal matrix. However, $A^TWA$ is not diagonal for the truncated DCT transform suggested in [15].

We use the following expression for the diagonal elements where the perceptual weighting was adopted from the CELP coding approach [13][38]:

$$W_{kk} = \left| \frac{A(z/\gamma_1)}{A(z)A(z/\gamma_2)} \right|^2_{z=\exp\left(j\frac{2\pi k f_p}{F_s}\right)} \tag{17}$$

where we have found that the parameter values $\gamma_1=0.94$ and $\gamma_2=0.85$ gave the best performance in our preferred embodiment of the hybrid coder. A refined weighting function, taking into account the experimental tone-to-tone, and noise-to-tone frequency masking properties, may further improve the perceptual quantization of the spectral envelope and is the subject of current research.

Since the bandlimited interpolation presents some computation and optimality problems, we decided to test the VDVQ and the zero padding methods only. To capture the varying characteristics of the spectral vector under different pitch values, the pitch frequency range was divided into 6 zones, and gain-shape codebooks were designed for each zone. This is a sub-optimal but practical approximation of the "optimal" approach of designing a codebook for each value of M, which was discussed at the beginning of this section. The same gain-shape quantization scheme was tested for the VDVQ and for the zero-padding methods, where the gain was quantized using a six bit predictive scalar quantizer in the Log domain, and the shape was quantized by a two-stage jointly optimized vector quantization using seven bits for each stage. Since the zero-padding method performed slightly better than the VDVQ method, it was chosen for our 4 kbps coder.

3.10 Voiced and Unvoiced Coding

The harmonic model for the voiced speech is based on the assumption that the perceptually important information resides essentially at the harmonic samples of the pitch frequency. These samples are complex valued, providing both magnitude and phase information. The phase information consists of three terms; the linear phase, the harmonic phase and the dispersion phase. The linear phase component is simply the time shift of the signal, the harmonic phase is the time integral of the pitch frequency, and the dispersion phase governs the structure of the pitch event and is related to the structure of the glottal excitation.

For low bit-rate harmonic coding, the dispersion terms of the phases are usually discarded, the harmonic phase is reconstructed solely as an approximated integral of the pitch frequency, and the linear phase is chosen arbitrarily. For our hybrid coder, arbitrarily chosen linear phase might create signal discontinuity on the frames boundary, and our codec estimates the linear phase term for the harmonic reconstruction when it is switches from the transition model to the harmonic model.

For steady-state voiced frames, the harmonic bandwidth may coincide with the entire signal bandwidth. In other cases of voiced frames, we call the frame "mixed". In this case, the harmonic part of the spectrum is modeled as described earlier for harmonic speech; for the frequency range above the harmonic bandwidth, the model adds densely spaced sine waves (e.g. 100 Hz spacing is used in our implementation) with random phases and the magnitudes are obtained by local averaging of the spectrum.

Unvoiced speech is generated from dense samples of the spectral magnitude combined with random phases. The sampling of the spectrum is performed by averaging the spectral envelope around the sampling point. The sampling intervals of the non-harmonic portion of the spectrum can be constant, as done for purely unvoiced speech, or can be related to the pitch value, as done for mixed voice speech.

Since no phase information is sent from the encoder to the decoder, only the spectral magnitude information needs to be quantized and sent. A major problem in harmonic spectral quantization is the varying size of the vector of harmonic samples, which is inversely proportional to the pitch frequency. Applying VQ to the variable dimension vector is an interesting problem which was address extensively and has many possible solution [4][5]. We use the concept of linear dimension conversion, and more particular—samples padding for vectors with less or equal to forty-eight samples and samples averaging for vectors with more than 48 samples. This approach can be considered as VQ with codebook sharing, sometimes called "constrained storage VQ" [See "Constrained Storage Vector Quantization with a Universal Codebook" by S. Ramakrishnan, K. Rose, A. Gersho, IEEE Trans. Image Processing, June 1998, incorporated herein by reference], of the optimal VQ approach which should use a specially designed VQ for each possible dimension of the spectral vector. In particular, we design six codebooks, each can be considered as a VQ with codebook sharing for a range of dimensions as summarized in Table 1.

The first 5 codebooks use dimension expansion while the 6th use dimension reduction. A special codebook with vector length 39 was designed for the pure unvoiced samples of the spectrum. All codebooks use 14 bits in a two-stage structure of 7 bits each, and employ a perceptually motivated distortion measure.

The decoder obtains the quantized spectral information. The decoder then combines the spectral magnitude with the estimated linear phase and the harmonic phase (as an integral of the pitch frequency) to generate the harmonic speech, and combines it with random phase to generate the unvoiced speech.

3.11 Transition Signal Coding

Many possible waveform coding models can be used, which can be time-domain based (e.g., pulse excitation), frequency domain based (e.g., sum of sinusoids with specific phase), or a combination of both (e.g., wavelets). We chose to use a time domain coder for the transition portion of the speech. We use a special multipulse coding model to represent the locations, structure, and the strength of the local time events that characterize transition speech. This type of multipulse coding is the same as the method described in [26] except that we use a different configuration of pulse locations as described below. The multipulse scheme uses the AbS method [39] with non-truncated impulse response for the search of the best pulse locations. Since long term prediction is less important for the transition segments, no adaptive codebook was used in conjunction with the multipulse excitation. However, a switchable adaptive codebook, used only if its prediction gain is high, may be considered and may help at a vowel-consonant transition segment or for the case of a classification error which classifies a harmonic frame as a transition frame. Such an adaptive codebook may provide additional class overlap and increase the coding robustness to classification errors.

We tested a number of combined pulse and gain schemes for the 10 ms subframe structure and decided to use a set of pulses to represent the local time events. More precisely, we used a set of 5 pulses, each pulse have a specific sign, and a single gain term which multiplies all pulses. The pulse locations are limited to a grid. The pulse signs are determined by the sign of the residual signal on each possible location on the grid, and the optimal pulse locations are found using an analysis-by-synthesis approach (see FIG. 4D). The optimal gain term is calculated and quantized using a predictive scalar quantizer. Since only 19 bits are available to describe the pulse locations, we confined the pulses into one out of the two tracks. Table 2 gives the possible locations for each pulse for the first track.

The locations for the second track are obtained by adding one to the locations in this table. The optimal pulse positions are found by a full search AbS scheme using the perceptually weighted speech as a target signal. A reduced complexity pruned search was tested as well and did not produce any perceptual degradation. An optimal gain term applied for the five pulses is calculated and quantized using a six bits predictive scalar quantizer in the logarithmic domain.

Note also that a transition frame that follows immediately after a harmonic frame might not be aligned with the preceding harmonic frame. The encoder can estimate this misalignment by comparing the degree of misalignment between the reconstructed harmonic speech and the original speech. It than applies the same shift to the analysis of the transition frame, providing a smooth signal on the frames boundary.

3.12 Bit Allocation

The bit allocation table for the harmonic speech segments and the stationary unvoiced speech segments is given in Table 3. The index 0 of the harmonic bandwidth indicates a stationary unvoiced segment, for which the pitch frequency bits are not used. The bit allocation table for the transition speech segments is given in Table 4.

4. Experimental Results

A formal quality test was conducted using an automatic classifier, pitch detector and harmonic bandwidth estimator in accordance with the present invention. In this test we used the harmonic model for voiced speech, the noise model for stationary unvoiced speech and the original residual for transition segments, and employed the phase synchronization modules during switching.

The unquantized model was compared to the ITU-T recommendation G.726 32 kbps ADPCM coder, with pre- and post-coding by the ITU-T recommendation G.711 64 kbps PCM coder. The absolute category rating (ACR) test was conducted, using 16 short sentence pairs from the TIMIT data base, eight from female talkers and eight from male talkers, which were judged by 10 non-expert listeners. The Mean Opinion Score (MOS) for our combined model was 3.66 while the MOS score for the 32 kbps ADPCM coder was 3.50.

On the above 16 short sentence pairs the classification algorithm classified 49.8% of the 10 ms frames as harmonic, 36.9% as stationary unvoiced and 13.3% as transition frames. These percentages take into account only the actual speech, without the short silence periods which come before, between, and after each sentence pair. These results clearly indicate that the harmonic model for the periodic speech and the noise model for the stationary unvoiced speech are adequate for high quality reproduction of speech, as long as an appropriate model is used for the representation of the small percentage of transition segments.

5. Conclusion

We have presented a novel hybrid coding approach for low bit rate compression of speech signals. The hybrid coder is based on speech classification into three classes: voiced, unvoiced, and transition, where a different coding scheme is employed for each class. We demonstrated the perceptual importance of the transition segments and added a particular time domain coding scheme for their representation, thus improving over traditional harmonic coders which distinguish only between voiced and unvoiced speech.

The interoperability of the time domain coder for transition frames and the frequency domain coder for voiced frames requires phase synchronization when switching from one scheme to the other. We have presented the details of such synchronization scheme, which provides signal continuity on the frame boundaries.

We have designed a 4 kbps coder based on the hybrid coding scheme. The coder uses a neural network for speech classification which was trained from a large database of manually classified speech frames. We developed a simple and efficient vector quantization scheme, based on zero padding of spectral samples for dimension conversion and perceptually weighted multi-stage vector quantization structure. A different codebook was designed for each of six ranges of the pitch frequency in order to capture the statistical characteristics of each range.

Those skilled in the art will appreciate that the functional elements of the encoder and decoder described herein can be implementing using conventional hardware and signal processing techniques. It will also be appreciated that the signal processing steps can be implemented using conventional software and programming techniques.

Formal subjective listening tests demonstrated that the quality of our 4 kbps coder is close to the state-of-art CELP type coder at 5.3 kbps. Past experience teaches us that a considerable amount of testing and tuning is needed to bring any new coding scheme to its full capability. We believe that further research into the numerous difficult problems involved in hybrid coding, such as classification, pitch detection and modeling, spectral modeling and quantization, modeling of transition segments, and the switching schemes, can yield a robust hybrid coder which can provide high quality speech at low bit rate.

The class-based hybrid coding method can be easily utilized for a variable rate coding of speech. The rate for each class can be set for an efficient tradeoff between quality and an average bit rate. It is clear that the bit rate needed for adequate representation of unvoiced speech can reduced to below 4 kbps. Further studies are needed to determine the optimal bit allocation for voiced and transition segments, according to a desired average bit rate.

Although the description above contains many specificities, these should not be construed as limiting the scope of the invention but as merely providing illustrations of some of the presently preferred embodiments of this invention. Thus the scope of this invention should be determined by the appended claims and their legal equivalents.

TABLE 1

| Codebook Number | Range of Vector Dimensions | Codebook Size |
|---|---|---|
| 1 | 10–16 | 16 |
| 2 | 17–24 | 24 |
| 3 | 25–32 | 32 |
| 4 | 33–40 | 40 |
| 5 | 41–48 | 48 |
| 6 | 49–75 | 75 |

TABLE 2

| Pulse Number | Pulse Location |
|---|---|
| p0 | 0, 5, 10, 15, 20, 25, 30, 35, 40, 45, 50, 55, 60, 65, 70, 75 |
| p1 | 2, 12, 22, 32, 42, 52, 62, 72 |
| p2 | 4, 9, 14, 19, 24, 29, 34, 39, 44, 49, 54, 59, 64, 69, 74, 79 |
| p3 | 6, 16, 26, 36, 46, 56, 66, 76 |
| p4 | 3, 8, 13, 18, 23, 28, 33, 38, 43, 48, 53, 58, 63, 68, 73, 78 |

TABLE 3

| Parameter | Frame | Subframe | Total |
|---|---|---|---|
| LSFs | 18 | | 18 |
| Class | | 1 | 2 |
| Pitch Frequency | | 7 | 14 |
| Harmonic Bandwidth | | 3 | 6 |
| Harmonic Spectrum | | 14 | 28 |
| Gain | | 6 | 12 |
| | | | 80 |

TABLE 3

| Parameter | Frame | Subframe | Total |
|---|---|---|---|
| LSFs | 18 | | 18 |
| Class | | 1 | 2 |
| Pulse Locations | | 19 | 38 |

TABLE 3-continued

| Parameter | Frame | Subframe | Total |
|---|---|---|---|
| Pulse Signs | | 5 | 10 |
| Gain | | 6 | 12 |
| | | | 80 |

What is claimed is:

1. A method for encoding speech in an encoder for communication to a decoder for reproduction thereof, said speech comprising a plurality of frames of speech, said method comprising the steps of:

(a) classifying each frame of speech into three or more classes wherein one or more of said classes is transitory in character;

(b) representing the speech in a frame of speech associated with at least one of said classes with a harmonic model;

(c) computing parameter values of said harmonic model where said parameter values are characteristic of the frame;

(d) quantizing said parameters for communication to said decoder; and (e) phase aligning reproduced speech across the boundary between two successive frames of speech where one frame of speech is waveform coded and the other frame of speech is harmonic coded.

2. A method for encoding speech in an encoder for communication to a decoder for reproduction thereof, said speech comprising a plurality of frames of speech, said method comprising the steps of:

(a) classifying each frame of speech into three or more classes wherein one or more of said classes is transitory character;

(b) representing the speech in a frame of speech associated with at least one of said classes with a harmonic model;

(c) computing parameter values of said harmonic model where said parameter values characteristic of the frame;

(d) quantizing said parameters for communication to said decoder; and (e) phase aligning a harmonic coded frame of speech in the decoder when the preceding frame of speech has been waveform coded for pairs of adjacent frames of speech comprising a waveform coded frame of speech adjacent to a harmonic coded frame of speech.

3. A method for encoding speech in an encoder for communication to a decoder for reproduction thereof, said speech comprising a plurality of frames of speech, said method comprising the steps of:

(a) classifying each frame of speech into three or more classes wherein one or more of said classes is transitory in character;

(b) representing the speech in a frame of speech associated with at least one of said classes with a harmonic model;

(c) computing parameter values of said harmonic model where said parameter values are characteristic of the frame;

(d) quantizing said parameters for communication to said decoder; and (e) phase aligning the frame in the encoder to be waveform coded when the subsequent frame is to be harmonic coded for pairs of adjacent frames comprising a waveform coded frame adjacent to a harmonic coded frame.

4. A hybrid method of encoding speech in an encoder for transmission to a decoder for reproduction thereof, comprising the steps of:

(a) classifying frames of the speech signal into steady state voiced, stationary unvoiced, or transitory speech segments;

(b) coding a frame with harmonic coding if the frame is classified as steady state voiced speech;

(c) coding a frame with "noise-like" coding if the frame is classified as stationary unvoiced speech;

(d) coding a frame classified as transitory using a coding technique selected from the group consisting of waveform coding, analysis-by-synthesis coding, codebook excited linear prediction analysis-by-synthesis coding, and multipulse analysis-by-synthesis coding; and (e) phase aligning a harmonic coded frame of speech in the decoder when the preceding frame of speech had been waveform coded for pairs of adjacent frames of speech comprising a waveform coded frame of speech adjacent to a harmonic coded frame of speech.

5. A hybrid method of encoding speech in an encoder for transmission to a decoder for reproduction thereof, comprising the steps of:

(a) classifying frames of the speech signal into steady state voiced, stationary unvoiced, or transitory speech segments;

(b) coding a frame with harmonic coding if the frame is classified as steady state voiced speech;

(c) coding a frame with "noise-like" coding if the frame is classified as stationary unvoiced speech;

(d) coding a frame classified as transitory using a coding technique selected from the group consisting of waveform coding, analysis-by-synthesis coding, codebook excited linear prediction analysis-by-synthesis coding, and multipulse analysis-by-synthesis coding; and (e) phase aligning the frame in the encoder to be waveform coded when the subsequent frame is to be harmonic coded for pairs of adjacent frames comprising a waveform coded frame adjacent to a harmonic coded frame.

6. A hybrid speech encoder for communication to a decoder for reproduction of speech, said speech comprising a plurality of frames of speech, said encoder comprising:

(a) means for classifying each frame of speech into three or more classes wherein one or more of said classes is transitory in character;

(b) means for representing the speech in a frame of speech associated with at least one of said classes with a harmonic model;

(c) means for computing parameter values of said harmonic model where said parameter values are characteristic of the frame;

(d) means for quantizing said parameters for communication to said decoder; and (e) means for phase aligning reproduced speech across the boundary between two successive frames of speech where one frame of speech is waveform coded and the other frame of speech is harmonic coded.

7. A hybrid speech encoder for communication to a decoder for reproduction of speech, said speech comprising a plurality of frames of speech, said encoder comprising:

(a) means for classifying each frame of speech into three or more classes wherein one or more of said classes is transitory in character;

(b) means for representing the speech in a frame of speech associated with at least one of said classes with a harmonic model;

(c) means for computing parameter values of said harmonic model where said parameter values are characteristic of the frame;

(d) means for quantizing said parameters for communication to said decoder; and (e) means for phase aligning a harmonic coded frame of speech in the decoder when the preceding frame of speech has been waveform coded for pairs of adjacent frames of speech comprising a waveform coded frame of speech adjacent to a harmonic coded frame of speech.

8. A hybrid speech encoder for communication to a decoder for reproduction of speech, said speech comprising a plurality of frames of speech, said encoder comprising:

(a) means for classifying each frame of speech into three or more classes wherein one or more of said classes in transitory in character;

(b) means for representing the speech in a frame of speech associated with at least one of said classes with a harmonic model;

(c) means for computing parameter values of said harmonic model where said parameter values are characteristic of the frame;

(d) means for quantizing said parameters for communication to said decoder; and (e) means for phase aligning the frame in the encoder to be waveform coded when the subsequent frame is to be harmonic coded for pairs of adjacent frames comprising a waveform coded frame adjacent to a harmonic coded frame.

9. An apparatus for encoding speech for transmission to a decoder for reproduction thereof, comprising:

(a) means for classifying frames of the speech signal as steady state voiced, stationary unvoiced, or transitory speech;

(b) means for coding a frame with harmonic coding if the frame is classified as steady state voiced speech;

(c) means for coding a frame with "noise-like" coding if the frame is classified as stationary unvoiced speech;

(d) means for coding a frame classified as transitory using a coding technique selected from the group consisting of waveform coding, analysis-by-synthesis coding, codebook excited linear prediction analysis-by-synthesis coding, and multipulse analysis-by-synthesis coding; and (e) means for phase aligning a harmonic coded frame of speech in the decoder when the preceding frame of speech has been waveform coded for pairs of adjacent frames of speech comprising a waveform coded frame of speech adjacent to a harmonic coded frame of speech.

10. An apparatus for encoding speech for transmission to a decoder for reproduction thereof, comprising:

(a) means for classifying frames of the speech signal as steady state voiced, stationary unvoiced, or transitory speech;

(b) means for coding a frame with harmonic coding if the frame is classified as steady state voiced speech;

(c) means for coding a frame with "noise-like" coding if the frame is classified as stationary unvoiced speech;

(d) means for coding a frame classified as transitory using a coding technique selected from the group consisting of waveform coding, analysis-by-synthesis coding, codebook excited linear prediction analysis-by-synthesis coding, and multipulse analysis-by-synthesis coding; and (e) means for phase aligning the frame in the encoder to be waveform coded when the subsequent frame is to be harmonic coded for pairs of adjacent frames comprising a waveform coded frame adjacent to a harmonic coded frame.

* * * * *